US011767182B2

(12) United States Patent
Kao et al.

(10) Patent No.: US 11,767,182 B2
(45) Date of Patent: Sep. 26, 2023

(54) ELECTRIC PAPER TRAY, AUTOMATIC DOCUMENT FEEDER WITH ELECTRIC PAPER TRAY AND AUTOMATIC SWITCHING METHOD OF AUTOMATIC DOCUMENT FEEDER WITH ELECTRIC PAPER TRAY

(71) Applicant: Foxlink Image Technology Co., Ltd., New Taipei (TW)

(72) Inventors: Shih Chao Kao, New Taipei (TW); Ching Feng Liao, New Taipei (TW); Jing Hua Fang, New Taipei (TW); Pei Chun Lu, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 314 days.

(21) Appl. No.: 17/243,224

(22) Filed: Apr. 28, 2021

(65) Prior Publication Data

US 2022/0002099 A1 Jan. 6, 2022

(30) Foreign Application Priority Data

Jul. 2, 2020 (CN) ..... 202010626719.1

(51) Int. Cl.
*B65H 3/34* (2006.01)
*B65H 1/02* (2006.01)
(Continued)

(52) U.S. Cl.
CPC ..... *B65H 1/025* (2013.01); *B41J 13/103* (2013.01); *B65H 3/0684* (2013.01); *B65H 3/34* (2013.01)

(58) Field of Classification Search
CPC ..... B65H 1/025; B65H 3/0684; B65H 3/34; B65H 2405/324
See application file for complete search history.

(56) References Cited

U.S. PATENT DOCUMENTS 8,215,635 B2 * 7/2012 Wada ..... B65H 1/266 271/160
9,332,144 B2 * 5/2016 Kozaki ..... H04N 1/00525
(Continued)

FOREIGN PATENT DOCUMENTS

CN 203474001 U 3/2014
CN 205274787 U 6/2016
(Continued)

OTHER PUBLICATIONS

Japan Patent Office, 1st Office Action, Patent Application No. JP2020-130853, dated Jul. 6, 2021.
(Continued)

*Primary Examiner* — Howard J Sanders
(74) *Attorney, Agent, or Firm* — LIN & ASSOCIATES INTELLECTUAL PROPERTY, INC.

(57) ABSTRACT

An electric paper tray includes a base, a paper holding element pivotally mounted to at least one side of the base, a power unit arranged at the base, and a lifting module connected between the paper holding element and the power unit. The lifting module is movably mounted under the paper holding element. When the lifting module is driven by the power unit to move to a first position, with respect to the base, the lifting module drives the paper holding element to make the paper holding element rotate to a closed position, when the lifting module is driven by the power unit to move to a second position, with respect to the base, the lifting module drives the paper holding element to make the paper holding element rotate to an opened position.

17 Claims, 26 Drawing Sheets

(51) Int. Cl.
*B65H 3/06* (2006.01)
*B41J 13/10* (2006.01)

(56) References Cited

U.S. PATENT DOCUMENTS

| | | | | |
|---|---|---|---|---|
| 9,382,088 | B2 * | 7/2016 | Miura | B65H 3/68 |
| 9,522,793 | B2 * | 12/2016 | Murodate | B65H 1/266 |
| 9,527,686 | B2 * | 12/2016 | Wang | B65H 83/02 |
| 9,574,652 | B2 * | 2/2017 | Hong | F16H 55/17 |
| 9,771,233 | B2 * | 9/2017 | Miura | B65H 31/02 |
| 10,399,801 | B2 * | 9/2019 | Yamada | B65H 31/24 |
| 2004/0041333 | A1 * | 3/2004 | Izumi | G03G 15/6529 271/145 |
| 2022/0002109 | A1 * | 1/2022 | Valenzuela-Rivas | B65H 31/02 |

FOREIGN PATENT DOCUMENTS

| | | |
|---|---|---|
| JP | H02-105954 | 8/1990 |
| JP | H02-248965 | 10/1990 |
| JP | H04-127755 | 11/1992 |

OTHER PUBLICATIONS

Japan Patent Office, 2nd Office Action, Patent Application No. JP2020-130853, dated Nov. 9, 2021.
China Patent Office, 1st Office Action, Patent Application No. CN202010626719.1, dated Jun. 29, 2023.

* cited by examiner

ELECTRIC PAPER TRAY, AUTOMATIC DOCUMENT FEEDER WITH ELECTRIC PAPER TRAY AND AUTOMATIC SWITCHING METHOD OF AUTOMATIC DOCUMENT FEEDER WITH ELECTRIC PAPER TRAY

CROSS-REFERENCE TO RELATED APPLICATION

The present application is based on, and claims priority from, China Patent Application No. 202010626719.1, filed Jul. 2, 2020, the disclosure of which is hereby incorporated by reference herein in its entirety.

BACKGROUND OF THE INVENTION

1. Field of the Invention

The present invention generally relates to a paper tray, and more particularly to an electric paper tray, an automatic document feeder with the electric paper tray, and an automatic switching method of the automatic document feeder with the electric paper tray to automatically open or close the electric paper tray.

2. The Related Art

With reference to FIG. 25 and FIG. 26, conventionally, an output tray 100' of an automatic document feeder 300' is generally arranged below a paper loading tray 200' of the automatic document feeder 300'. In order to increase a usage space of the conventional automatic document feeder 300' and reduce a height of the conventional automatic document feeder 300'. In another automatic document feeder 300' shown in FIG. 26, the paper loading tray 200' is arranged below the output tray 100'.

However, the output tray 100' is arranged below the paper loading tray 200', a total height of the automatic document feeder 300' shown in FIG. 25 is limited by factors of an accommodating space of the automatic document feeder 300' for accommodating the paper and a paper pick-up space. Nevertheless, the output tray 100' is arranged above the paper loading tray 200', the automatic document feeder 300' shown in FIG. 26 also has disadvantages of the unaligned and stacked paper due to a poor decelerating rate, so the automatic document feeder 300' shown in FIG. 26 can only be used as a lower speed model, and when the automatic document feeder 300' shown in FIG. 26 is in use by a user, the user has to open the output tray 100' manually every time. Consequently, when the automatic document feeder 300' is used by users who are unfamiliar with the automatic document feeder 300', it will be inconvenient for the users who are unfamiliar with the automatic document feeder 300'.

Therefore, it is necessary to provide an innovative electric paper tray, an automatic document feeder with the electric paper tray and an automatic switching method of the automatic document feeder with the electric paper tray to automatically open or close the electric paper tray.

SUMMARY OF THE INVENTION

An object of the present invention is to provide an electric paper tray used in an automatic document feeder. The electric paper tray includes a base, a paper holding element pivotally mounted to at least one side of the base, a power unit arranged at the base, and a lifting module connected between the paper holding element and the power unit. A bottom of the paper holding element has at least one rotation shaft. The at least one rotation shaft is pivotally connected to the base. The lifting module is movably mounted under the paper holding element. When the lifting module is driven by the power unit to move to a first position, with respect to the base, the lifting module drives the paper holding element to make the paper holding element rotate to a closed position via the at least one rotation shaft, an outer surface of the paper holding element and a top surface of the automatic document feeder are connected and are shown as a continuous surface, at the moment, the outer surface of the paper holding element is used as an appearance surface of the automatic document feeder, when the lifting module is driven by the power unit to move to a second position, with respect to the base, the lifting module drives the paper holding element to make the paper holding element rotate to an opened position via the at least one rotation shaft, at the moment, a receiving space is formed between the paper holding element and the automatic document feeder.

Another object of the present invention is to provide an automatic document feeder with an electric paper tray. The automatic document feeder with the electric paper tray includes a base, a feeding path disposed in the base, a pickup module, a plurality of transmission roller modules, a paper loading tray and an electric paper tray. An upstream and a downstream of the feeding path have a paper inlet and a paper outlet, respectively. The pickup module is mounted to the paper inlet. The plurality of the transmission roller modules are arranged along the feeding path. The paper loading tray is connected with the base and is disposed to one of the paper inlet and the paper outlet. The electric paper tray is disposed to the other one of the paper inlet and the paper outlet. The electric paper tray includes a paper holding element pivotally mounted to at least one side of the base, a power unit arranged at the base, and a lifting module connected between the paper holding element and the power unit. A bottom of the paper holding element has at least one rotation shaft. The at least one rotation shaft is pivotally connected to the base. The lifting module is movably mounted under the paper holding element. When the lifting module is driven by the power unit to move to a first position, with respect to the base, the lifting module drives the paper holding element to make the paper holding element rotate to a closed position via the at least one rotation shaft, an outer surface of the paper holding element and a top surface of the base are connected and are shown as a continuous surface, at the moment, the outer surface of the paper holding element is used as an appearance surface of the automatic document feeder, the paper inlet or the paper outlet is shielded by the paper holding element of the electric paper tray, when the lifting module is driven by the power unit to move to a second position, with respect to the base, the lifting module drives the paper holding element to make the paper holding element rotate to an opened position via the at least one rotation shaft, at the moment, the paper inlet or the paper outlet is exposed out of the paper holding element of the electric paper tray.

Another object of the present invention is to provide an automatic switching method of an automatic document feeder with an electric paper tray. Specific steps of the automatic switching method of the automatic document feeder with the electric paper tray are described hereinafter. Detect whether paper is loaded in a paper loading tray of the automatic document feeder by a feed-in sensor of the automatic document feeder. Drive a lifting module of the electric paper tray by a power unit of the electric paper tray to open a paper holding element of the electric paper tray if the feed-in sensor detects the paper is loaded in the paper loading tray, on the contrary, repeat detecting whether the paper is loaded in the paper loading tray. Detect whether the paper holding element of the electric paper tray is opened and is switched from a first position to a second position by a lifting sensor of the automatic document feeder. Feed the paper into the automatic document feeder by a pickup module of the automatic document feeder, and feed the paper out to the paper holding element of the electric paper tray by a plurality of the transmission roller modules of the automatic document feeder if the paper holding element of the electric paper tray is opened to the second position. Judge whether the paper is detected in the paper holding element of the electric paper tray by a feed-out sensor of the automatic document feeder. Drive the lifting module by the power unit if the feed-out sensor is unable to detect any paper in the paper holding element of the electric paper tray, the lifting module drives the paper holding element of the electric paper tray to move to the first position to close the paper holding element of the electric paper tray, at the moment, an outer surface of the paper holding element of the electric paper tray and a top surface of a base of the electric paper tray are connected and are shown as a continuous surface, and the outer surface of the paper holding element of the electric paper tray is used as an appearance surface of the automatic document feeder.

As described above, the electric paper tray transmits a driving force to a transmission gear assembly of the electric paper tray by means of the power unit, the transmission gear assembly drives at least one lifting component of the electric paper tray to make the paper holding element proceed with an opened action and a closed action alternately, a first elastic element of the electric paper tray provides a needed supporting force to ensure that the paper holding element can remain opened after the paper holding element is opened. A second elastic element of the electric paper tray provides a closed force to close the paper holding element to ensure that the paper holding element is able to be closed. Thus, the electric paper tray is able to be opened and closed automatically, stacked quality of a feed-out paper of the electric paper tray is improved, a structural space of the electric paper tray of the automatic document feeder is reduced to lower a cost and increase an aesthetic feeling.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
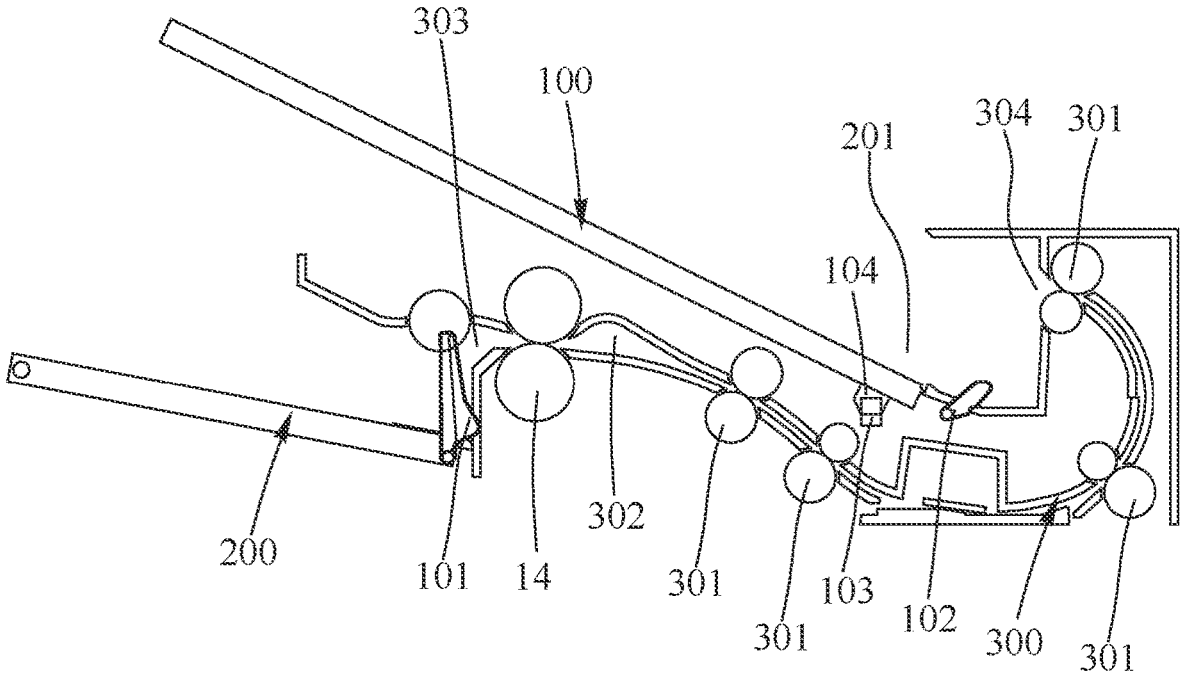
FIG. 1 shows a schematic diagram of an automatic document feeder with an opened electric paper tray in accordance with a first preferred embodiment of the present invention.
Figure 2:
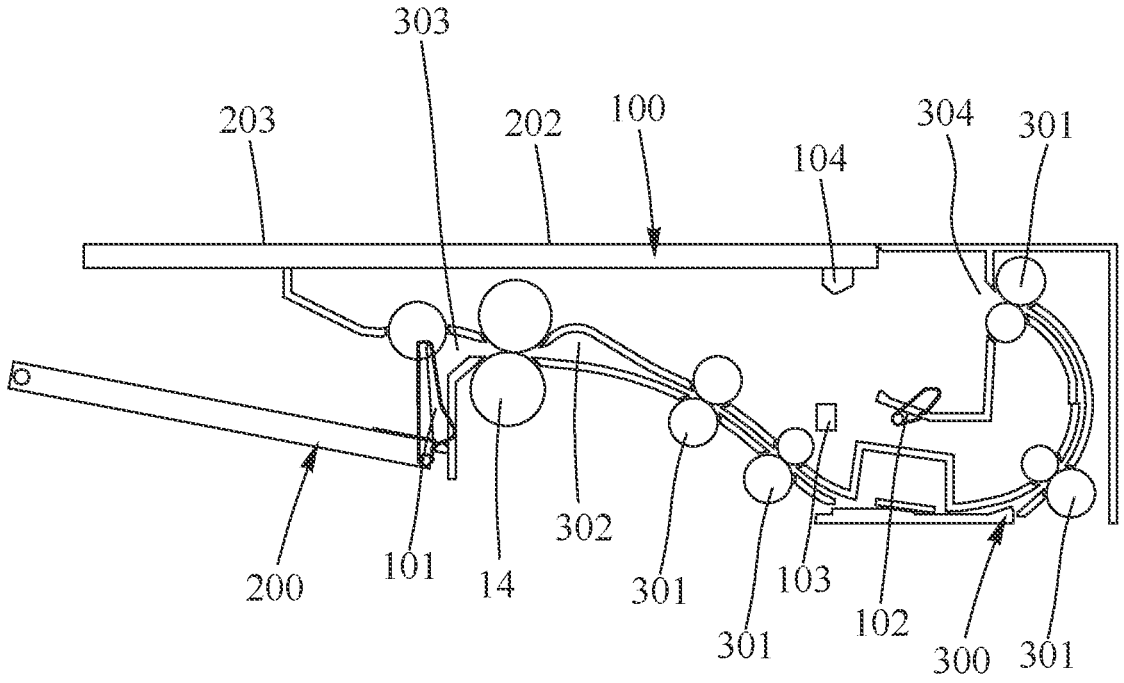
FIG. 2 shows a schematic diagram of the automatic document feeder with a closed electric paper tray in accordance with the present invention.

Referring to FIG. 1 and FIG. 2, an electric paper tray 100 in accordance with a first preferred embodiment of the present invention is shown. The electric paper tray 100 is used in an automatic document feeder (ADF) 300. The electric paper tray 100 is used as an output tray of the automatic document feeder 300. The automatic document feeder 300 with the electric paper tray 100 includes a paper loading tray 200 and a pickup module 14. The electric paper tray 100 is arranged above the paper loading tray 200. In this invention, the electric paper tray 100 improves a paper-out stacking problem and a lower speed of the automatic document feeder 300 under a condition of a height of the automatic document feeder 300 being without being increased.

Referring to FIG. 3 to FIG. 10, the electric paper tray 100 includes a base 1, a paper holding element 2, at least one lifting component 3, at least one supporting component 4, a transmission gear assembly 5 and a power unit 6. The paper holding element 2 of the electric paper tray 100 is pivotally mounted to at least one side of the base 1 and is connected to the base 1. The paper holding element 2 is pivotally mounted to two sides of the base 1. At least one side of a top of the base 1 is recessed downward to form at least one insertion groove 17. Two opposite sides of the top of the base 1 are recessed downward to form two insertion grooves 17. The paper holding element 2 is partially arranged above the base 1. A bottom of the at least one lifting component 3 is arranged at one end of the base 1, and a top of the at least one lifting component 3 is slidably contacted with a bottom surface of the paper holding element 2. The bottom of the at least one lifting component 3 is arranged in the base 1, and the top of the at least one lifting component 3 projects beyond a top surface of the base 1 and is able to slide along the bottom surface of the paper holding element 2. The at least one supporting component 4 is arranged at the bottom of the at least one lifting component 3 and is fastened in the base 1. The transmission gear assembly 5 is arranged at one side of the base 1. The power unit 6 is connected with the transmission gear assembly 5, and the power unit 6 is arranged at the one side of the base 1, so the power unit 6 and the transmission gear assembly 5 are positioned at the same side of the base 1. The power unit 6 and the transmission gear assembly 5 are connected to corresponding structures of the base 1. The automatic document feeder 300 has a feeding path 302 disposed in the base 1, and a plurality of transmission roller modules 301 arranged along the feeding path 302. An upstream and a downstream of the feeding path 302 has a paper inlet 303 and a paper outlet 304, respectively. The pickup module 14 is mounted to the paper inlet 303. The paper loading tray 200 is disposed to one of the paper inlet 303 and the paper outlet 304. The electric paper tray 100 is connected with the base 1 and is disposed to the other one of the paper inlet 303 and the paper outlet 304.

In this first preferred embodiment, the power unit 6 transmits a driving force to the transmission gear assembly 5. The transmission gear assembly 5 drives the at least one lifting component 3 to make the paper holding element 2 proceed with an opened operation or a closed operation. The power unit 6 applies a driving torque to the at least one lifting component 3 via the transmission gear assembly 5 to open and close the paper holding element 2. When the at least one lifting component 3 is driven to rotate to an opened position, a corresponding mechanism of the at least one supporting component 4 provides a needed supporting force for the opened paper holding element 2, the at least one supporting component 4 holds the at least one lifting component 3 in position to keep the paper holding element 2 being opened to a proper design angle. The proper design angle is a predefined angle. When the at least one lifting component 3 is driven to rotate to a closed position, the corresponding mechanism of the at least one supporting component 4 provides a closed force to close the paper holding element 2 to ensure that the paper holding element 2 is able to be closed so as to close the paper holding element 2.

Referring to FIG. 2 to FIG. 18, the base 1 is equipped with a separating gear 11, a driving shaft 12, a connecting gear 13 and the pickup module 14. The separating gear 11 is exposed outside to the one side of the base 1, and the separating gear 11, the transmission gear assembly 5 and the power unit 6 are arranged at the same side of the base 1. The separating gear 11 is connected to the power unit 6 to make the power unit 6 be able to transmit the driving force to the separating gear 11, and the separating gear 11 receives the driving force from the power unit 6. The driving shaft 12 is mounted to the base 1, and extends inward and towards the other side of the base 1. The driving shaft 12 is arranged at an inner side of the separating gear 11. The separating gear 11 is arranged at and is sleeved around one end of the driving shaft 12. The driving shaft 12 is arranged in the base 1.

The connecting gear 13 is arranged between the separating gear 11 and the driving shaft 12. The connecting gear 13 is arranged in the base 1. The connecting gear 13 is coaxially connected to the separating gear 11. When the power unit 6 transmits the driving force to the separating gear 11, the separating gear 11 rotates to be able to drive the connecting gear 13 and the driving shaft 12 to rotate. Besides, the connecting gear 13 is engaged with a corresponding part of the transmission gear assembly 5, so the separating gear 11 not only drives the pickup module 14, but also transmits the driving force to the transmission gear assembly 5 to open and close the electric paper tray 100 automatically. The pickup module 14 is mounted to and exposed below the base 1. one end of the driving shaft 12 is connected to the separating gear 11, and the other end of the driving shaft 12 is connected to one side of the pickup module 14.

In this first preferred embodiment, the automatic document feeder 300 further includes a lifting module 221. The lifting module 221 includes the separating gear 11, the connecting gear 13, the at least one lifting component 3, the at least one supporting component 4 and the transmission gear assembly 5. A bottom of the paper holding element 2 has at least one rotation shaft 25. The lifting module 221 is connected between the paper holding element 2 and the power unit 6. The lifting module 221 is movably mounted under the paper holding element 2. In the present invention, when the lifting module 221 is driven by the power unit 6 to move to the first position, with respect to the base 1, the lifting module 221 drives the paper holding element 2 to make the paper holding element 2 rotate to the closed position via the at least one rotation shaft 25, the outer surface of the paper holding element 2 and a top surface of the automatic document feeder 300 are connected and are shown as a continuous surface 203, at the moment, the outer surface of the paper holding element 2 is used as an appearance surface 202 of the automatic document feeder 300, the paper inlet 303 or the paper outlet 304 is shielded by the paper holding element 2 of the electric paper tray 100.

Specifically, the outer surface of the paper holding element 2 and a top surface of the base 1 are connected and are shown as the continuous surface 203. The top surface of the base 1 is defined as the top surface of the automatic document feeder 300. When the lifting module 221 is driven by the power unit 6 to move to the second position, with respect to the base 1, the lifting module 221 drives the paper holding element 2 to make the paper holding element 2 rotate to the opened position via the at least one rotation shaft 25, at the moment, a receiving space 201 is formed between the paper holding element 2 and the automatic document feeder 300. The paper inlet 303 or the paper outlet 304 is exposed out of the paper holding element 2 of the electric paper tray 100.

Referring to FIG. 3 to FIG. 20, an outer surface of the paper holding element 2 is used for loading paper. An inner surface of the paper holding element 2 has at least one sliding slot 21 recessed inward. The at least one lifting component 3 is slidably disposed in the at least one sliding slot 21. Two opposite ends of the at least one sliding slot 21 are defined as a first position 211 and a second position 212, respectively. An upper surface of the paper holding element 2 is used for loading the paper. A lower surface of the paper holding element 2 which is the inner surface of the paper holding element 2 has at least one sliding slot 21. The lower surface of the paper holding element 2 has two opposite sliding slots 21 spaced from each other. In this first preferred embodiment, the two recessed sliding slots 21 are arranged on the lower surface of the paper holding element 2 and are spaced from each other. The two sliding slots 21 extend along a front-to-rear direction of the paper holding element 2. Each sliding slot 21 is disposed parallel to a paper feeding direction.

At least one corresponding portion of the at least one lifting component 3 is positioned in and contacts with the at least one sliding slot 21. Two corresponding portions of the at least one lifting component 3 are positioned in and contact with the two sliding slots 21. The electric paper tray 100 of the automatic document feeder 300 further includes a pickup portion 22 and a blocking portion 23. A front end of the paper holding element 2 is equipped with the pickup portion 22 and the blocking portion 23. The pickup portion 22 is assembled at a corner of the front end of the paper holding element 2 via a pivot pin (not shown). When the paper holding element 2 is opened, the pickup portion 22 of the paper holding element 2 inclines downward due to a weight of the pickup portion 22 to facilitate for users to pick up the paper conveniently. The blocking portion 23 is connected with a middle of the front end of the paper holding element 2 and extends outward to block and reposition the paper fed out from the automatic document feeder 300 so as to avoid the paper fed out by the automatic document feeder 300 being placed in disorder. When electric paper tray 100 is closed, the blocking portion 23 is received in a front end of the inner surface of the paper holding element 2.

Figure 3:
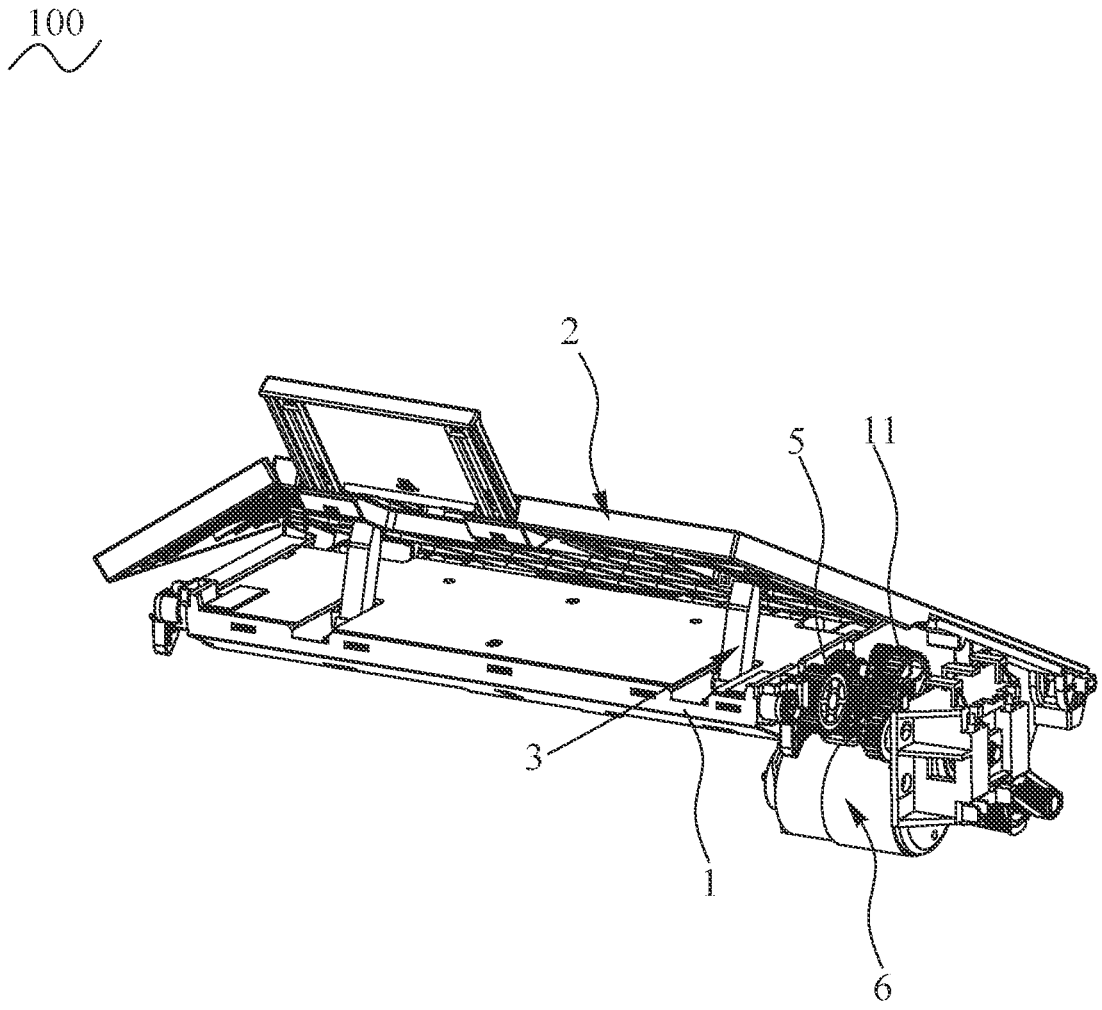
FIG. 3 is a perspective view of the automatic document feeder with the opened electric paper tray in accordance with the present invention.
Figure 4:
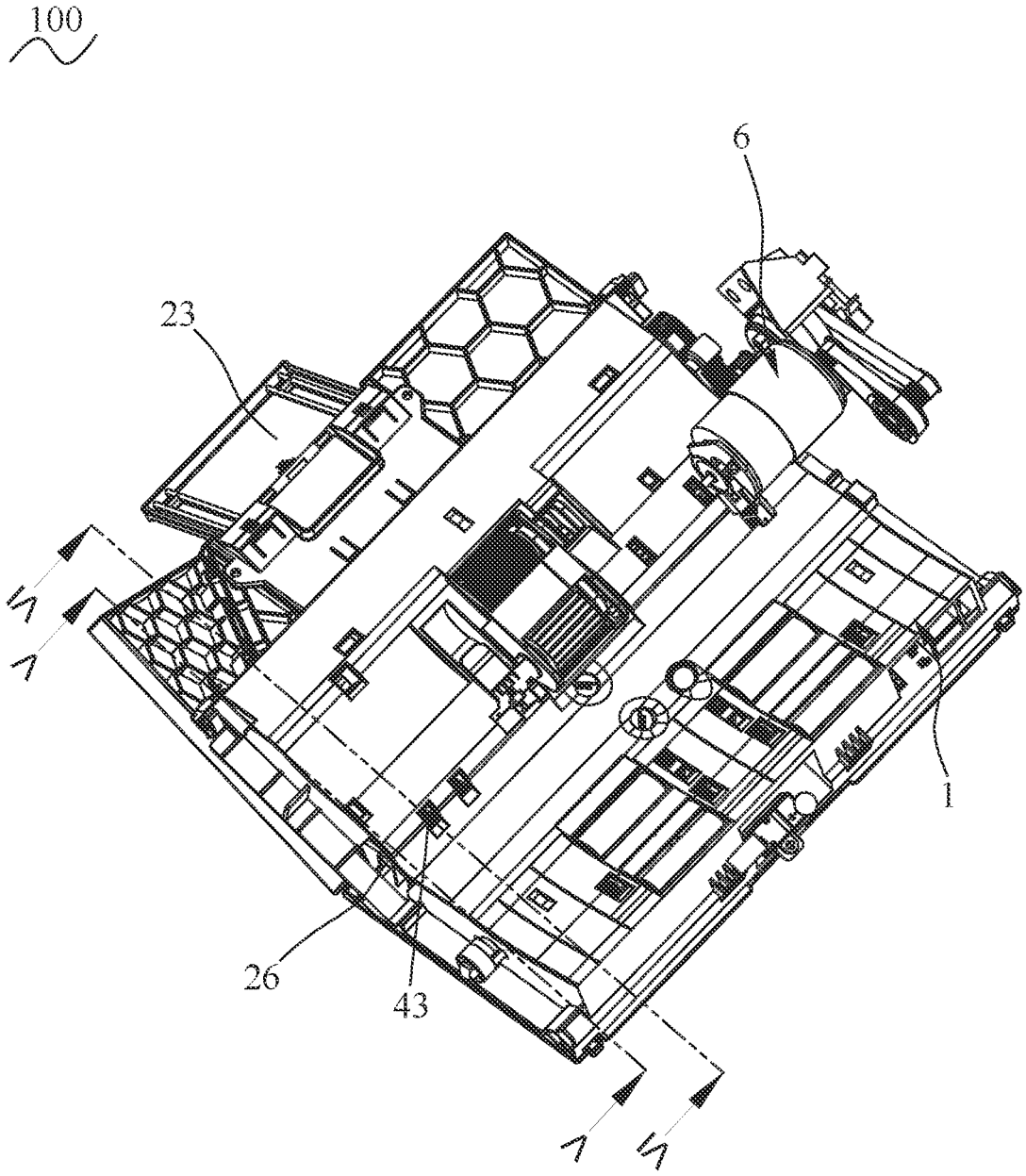
FIG. 4 is another perspective view of the automatic document feeder with the opened electric paper tray in accordance with the present invention.
Figure 5:
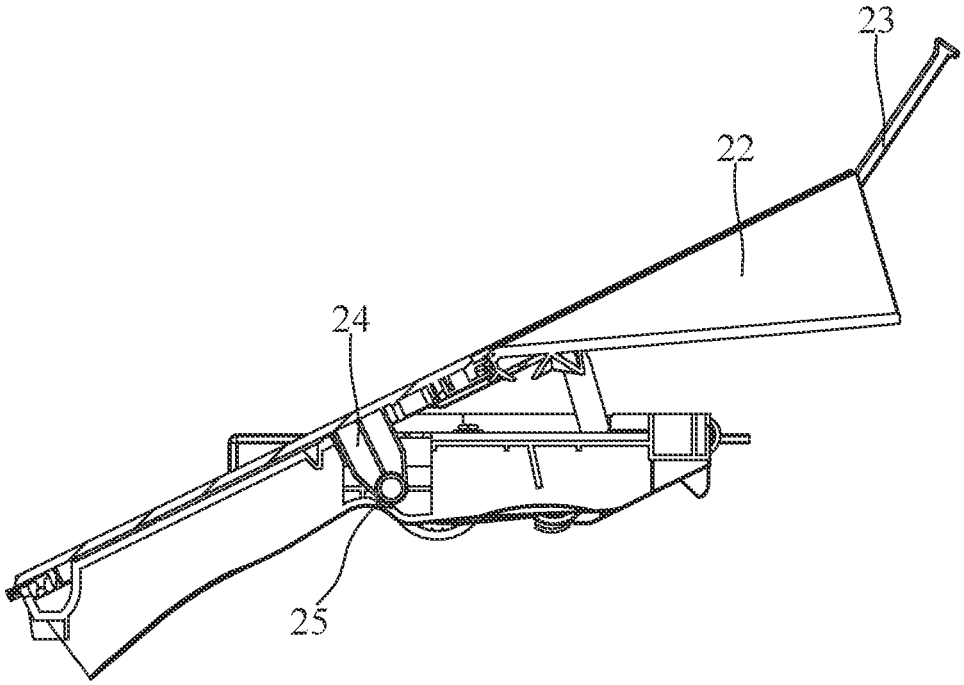
FIG. 5 is a sectional view of the automatic document feeder along a line V-V of FIG. 4.
Figure 6:
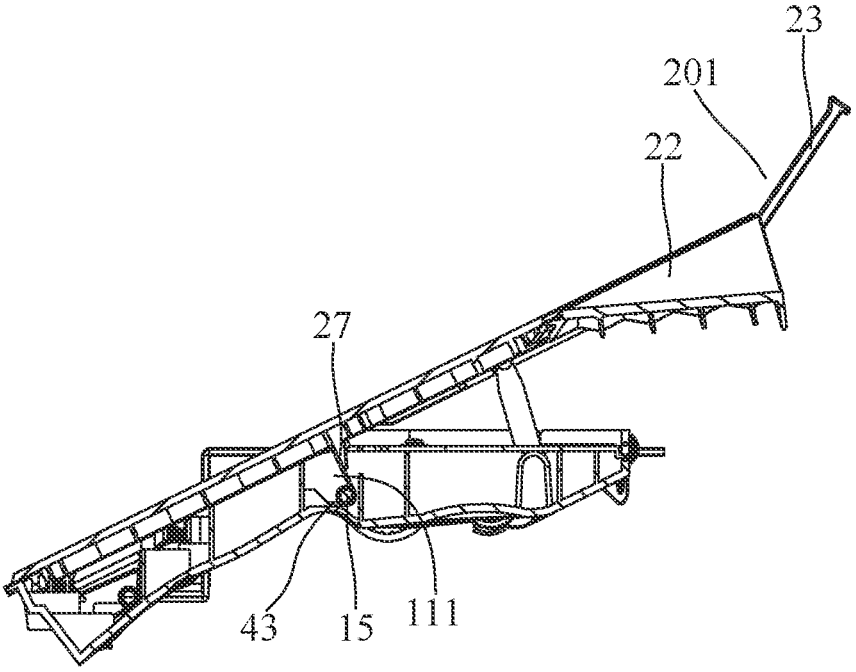
FIG. 6 is a sectional view of the automatic document feeder along a line VI-VI of FIG. 4.
Figure 7:
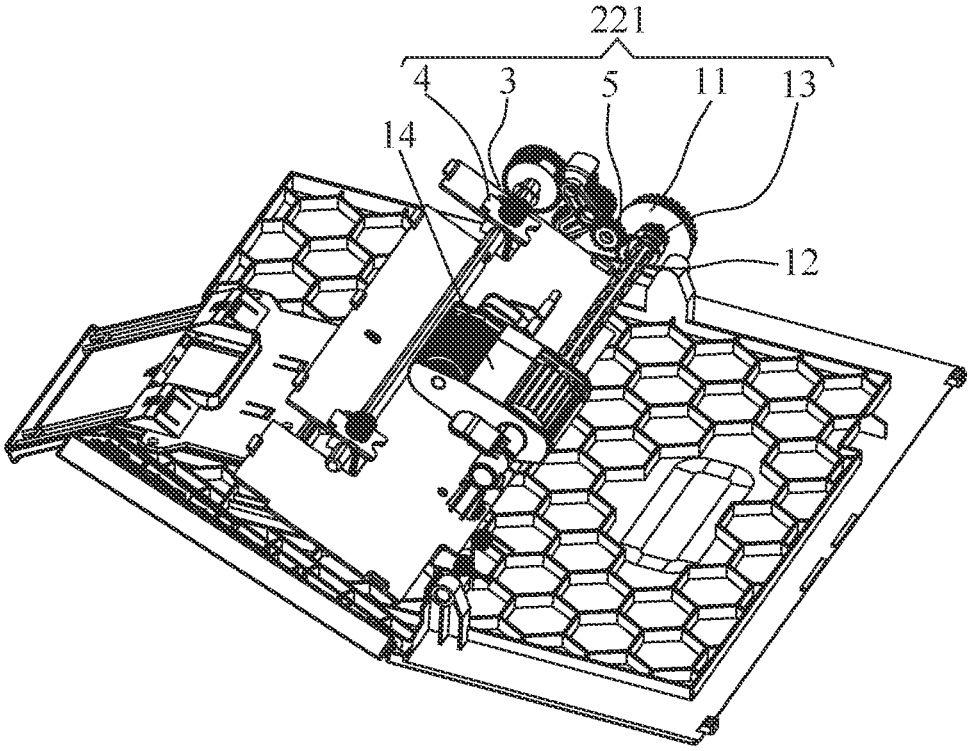
FIG. 7 is a partially perspective view of the automatic document feeder with the opened electric paper tray in accordance with the present invention.
Figure 8:
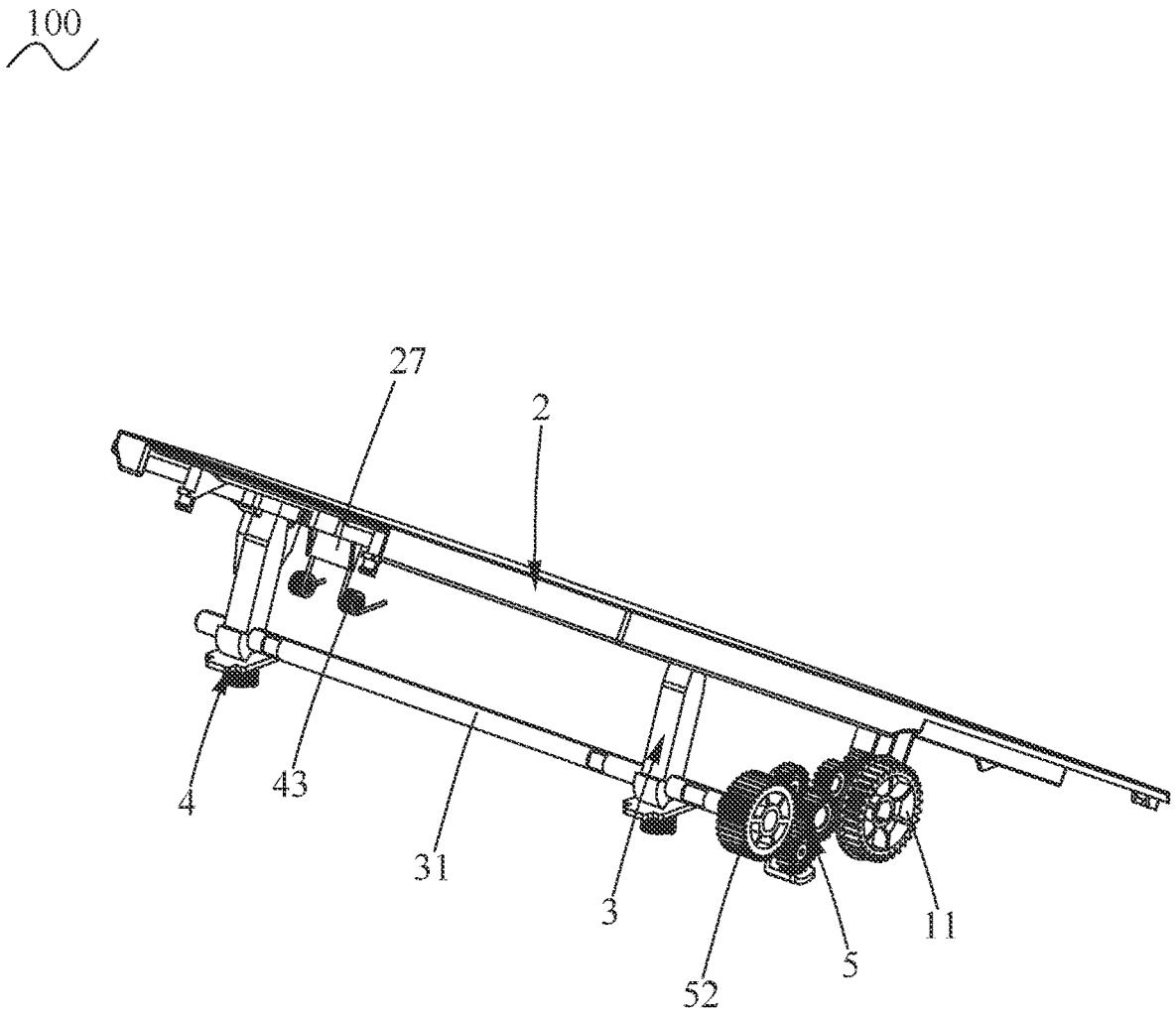
FIG. 8 is another perspective view of the automatic document feeder with the opened electric paper tray in accordance with the present invention.
Figure 9:
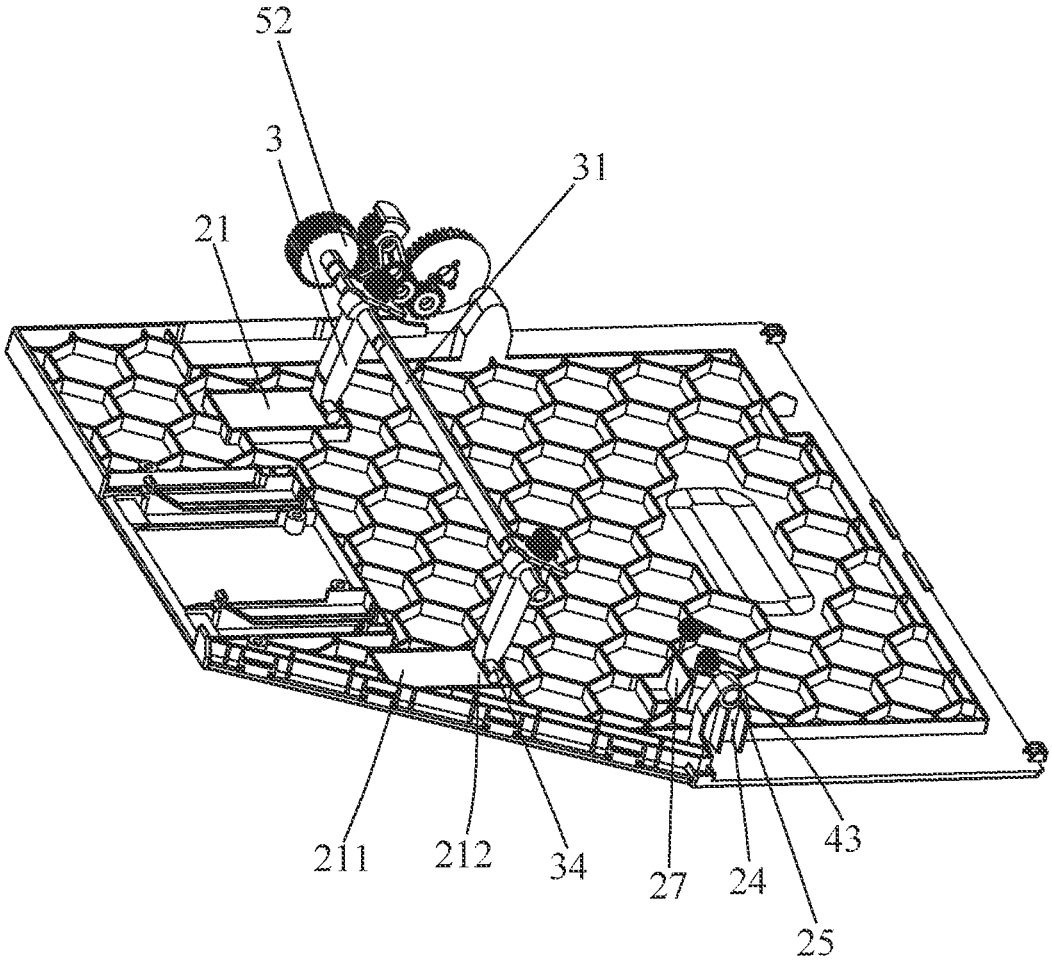
FIG. 9 is one more perspective view of the automatic document feeder with the opened electric paper tray in accordance with the present invention.
Figure 10:
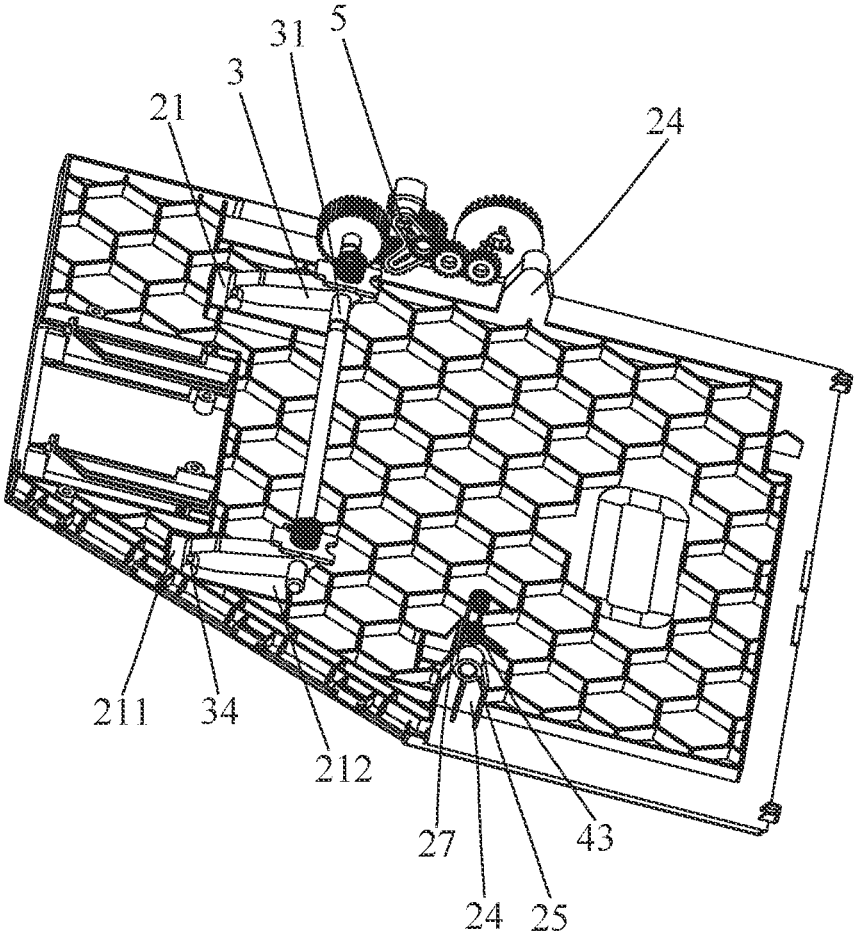
FIG. 10 is a partially perspective view of the automatic document feeder with the closed electric paper tray in accordance with the present invention.
Figure 11:
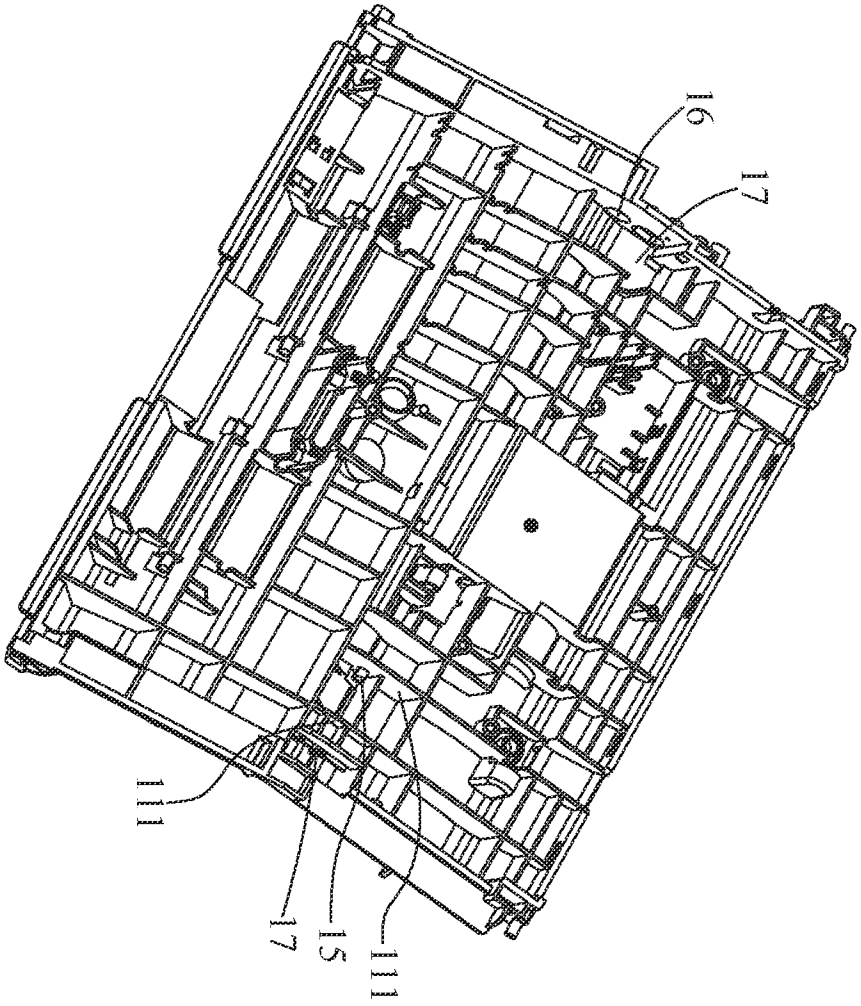
FIG. 11 is a perspective view of a base of the electric paper tray of the automatic document feeder in accordance with the present invention.

Referring to FIG. 1 to FIG. 10, each sliding slot 21 has the first position 211 and the second position 212 shown in FIG. 9 and FIG. 10. A front end and a rear end of each sliding slot 21 are defined as the first position 211 and the second position 212, respectively. When the at least one corresponding portion of the at least one lifting component 3 slides to the first position 211 of the at least one sliding slot 21, the electric paper tray 100 is closed, the upper surface of the paper holding element 2 and a top surface of the automatic document feeder 300 are located at a same level, at the moment, the upper surface of the paper holding element 2 is performed as an appearance surface 202 of the automatic document feeder 300 to make an appearance of the automatic document feeder 300 flat so as to make the user feels comfortable. When the at least one corresponding portion of the at least one lifting component 3 slides to the second position 212 of the at least one sliding slot 21 as shown in FIG. 3, FIG. 5 and FIG. 9, the electric paper tray 100 is opened, in the first preferred embodiment, an inclination angle is formed between the upper surface of the electric paper tray 100 and a bottom surface of the automatic document feeder 300, and the inclination angle formed between the upper surface of the electric paper tray 100 and the bottom surface of the automatic document feeder 300 is about twenty six degrees. The receiving space 201 is formed between the upper surface of the electric paper tray 100 and the top surface of the automatic document feeder 300 for loading the feed-out paper. Comparing the automatic document feeder 300 with the conventional automatic document feeder 300' that is designed with an inclination angle less than 10 degrees, the electric paper tray 100 in accordance with the present invention is able to effectively slow down a speed of feeding out the paper, thus the automatic document feeder 300 has a better paper stacked effect.

Referring to FIG. 7 to FIG. 20, a middle of at least one side of the paper holding element 2 protrudes downward to form at least one shaft seat 24. A bottom of the at least one shaft seat 24 has the at least one rotation shaft 25. The at least one shaft seat 24 is inserted into the at least one insertion groove 17. The at least one rotation shaft 25 is pivotally connected to the base 1. Middles of two sides of the paper holding element 2 protrude downward to form two shaft seats 24. The two shaft seats 24 are extended downward from left and right sides of the paper holding element 2 that are close to a center line of the paper holding element 2 respectively. A bottom of each shaft seat 24 has one rotation shaft 25. The one rotation shaft 25 of one shaft seat 24 is hollow. The two rotation shafts 25 of the two shaft seats 24 are connected with the base 1, and thus the paper holding element 2 is able to rotate with respect to the base 1 through the two rotation shafts 25 for controlling the electric paper tray 100 to alternately rotate to an opened state and a closed state. A distance between the first position 211 and the front end of the paper holding element 2 is smaller than a distance between the second position 212 and the front end of the paper holding element 2, so the first position 211 is closer to the front end of the paper holding element 2. A distance between the two rotation shafts 25 and the first position 211 is larger than a distance between the two rotation shafts 25 and the second position 212, so the second position 212 is closer to the two rotation shafts 25. In this first preferred embodiment, one rotation shaft 25 that is close to one side of the transmission gear assembly 5 is buckled to the one side of the base 1, and the other rotation shaft 25 is buckled to and locked to the other side of the base 1 via a screw bolt 26.

Referring to FIG. 6 to FIG. 15, the at least one lifting component 3 includes a connecting rod 31, at least one supporting arm 32, at least one cam 33 and at least one pivot portion 34. The connecting rod 31 passes through a bottom of the at least one supporting arm 32. The connecting rod 31 is arranged in a front end of the base 1. The connecting rod 31 is transversely mounted to the paper holding element 2. The connecting rod 31 is connected between the transmission gear assembly 5 and the at least one supporting arm 32. The connecting rod 31 is arranged across the left side and the right side of the paper holding element 2. The at least one pivot portion 34 is extended sideward from a top end of the at least one supporting arm 32. The at least one pivot portion 34 is slidable between the first position 211 and the second position 212 of the at least one sliding slot 21. A front end of the bottom of the at least one supporting arm 32 protrudes outward to form the at least one cam 33. The at least one pivot portion 34 abuts against the inner surface of the paper holding element 2. The at least one cam 33 arranged at the bottom of the at least one supporting arm 32 contacts and abuts against the corresponding mechanism of the at least one supporting component 4. A connecting portion between the connecting rod 31 and the at least one supporting arm 32 is located between the at least one cam 33 and the at least one pivot portion 34. In the first preferred embodiment, the lifting module 221 of the electric paper tray 100 includes two lifting components 3. The two lifting components 3 include two supporting arms 32, two cams 33 and two pivot portions 34. The connecting rod 31 passes through and is connected to the two supporting arms 32, and the two supporting arms 32 are arranged at two opposite ends of the connecting rod 31. Front ends of the bottoms of the two supporting arms 32 protrude outward to form the two cams 33.

Referring to FIG. 4 to FIG. 12, when the at least one pivot portion 34 of the at least one lifting component 3 moves to the first position 211 of the at least one sliding slot 21, at the moment, the electric paper tray 100 is closed. When the at least one pivot portion 34 of the at least one lifting component 3 moves to the second position 212, the electric paper tray 100 is opened. The at least one lifting component 3 is arranged among the two rotation shafts 25 of the paper holding element 2 and the front end of the paper holding element 2. When the at least one pivot portion 34 of the at least one lifting component 3 rotates to move to the second position 212, the front end of the paper holding element 2 is propped up by the pivot portion 34, and the paper holding element 2 rotates with respect to the base 1 and along the two rotation shafts 25, so that the electric paper tray 100 rotates to move to the opened state. When the at least one pivot portion 34 of the at least one lifting component 3 rotates to the first position 211, the front end of the paper holding element 2 is without being propped up by the at least one pivot portion 34, and the paper holding element 2 rotates with respect to the base 1 and along the two rotation shafts 25, so that the electric paper tray 100 rotates to move to the closed state.

Referring to FIG. 4 to FIG. 11, the at least one supporting component 4 includes at least one friction pad 41, at least one first elastic element 42, a second elastic element 43 and at least one fixed shaft 44. The at least one cam 33 is arranged on one side of a top surface of the at least one friction pad 41, and contacts with the friction pad 41. The at least one first elastic element 42 is arranged at a middle of a bottom surface of the at least one friction pad 41 and is opposite to the at least one cam 33. The middle of the bottom surface of the at least one friction pad 41 protrudes downward to form the at least one fixed shaft 44. The at least one fixed shaft 44 is arranged at the bottom surface of the friction pad 41, and the at least one first elastic element 42 and the at least one fixed shaft 44 are arranged at a same surface of the friction pad 41. The at least one first elastic element 42 is mounted around the at least one fixed shaft 44. The at least one fixed shaft 44 is used for fastening and limiting a position of the at least one first elastic element 42. The second elastic element 43 is disposed to the inner surface of the paper holding element 2. The second elastic element 43 is arranged at the bottom surface of the paper holding tray 2 and is fixed in a middle section of the base 1. Two opposite ends of the at least one first elastic element 42 abut between an upper surface of the base 1 and the bottom surface of the at least one friction pad 41 to provide a force for maintaining that the at least one lifting component 3 is located at the first position 211 or the second position 212.

In this first preferred embodiment, the electric paper tray 100 includes two supporting components 4. The two supporting components 4 include two friction pads 41, two first elastic elements 42 and two fixed shafts 44. The at least one first elastic element 42 is a compression spring, and the second elastic element 43 is a torsion spring.

Referring to FIG. 4 to FIG. 13, in the first preferred embodiment, one side of the inner surface of the paper holding element 2 protrudes downward to form a retaining wall 27. One end of the second elastic element 43 abuts against the retaining wall 27 of the inner surface of the paper holding element 2. A top end of the second elastic element 43 is blocked by and abuts against a rear surface of the retaining wall 27 of the bottom surface of the paper holding element 2. Two sides of an upper surface of the other side of the base 1 protrude upward to form two blocking walls 111. Two facing surfaces of the two blocking walls 111 protrude toward each other to form two fixing portions 15. The other end of the second elastic element 43 abuts against the base 1. The two opposite ends of the second elastic element 43 abut between the base 1 and the inner surface of the paper holding element 2. Two opposite sides of the second elastic element 43 sleeve around the two fixing portions 15 in the base 1. The two fixing portions 15 are adjacent to the one insertion groove 17. One fixing portion 15 projects beyond an outer surface of one blocking wall 111 and projects into the one insertion groove 17. An outer wall of the other insertion groove 17 defines a pivoting hole 16 transversely penetrating through the outer wall of the other insertion groove 17. One fixing portion 15 and the one rotation shaft 25 are coaxial. The one shaft seat 24 is inserted into the one insertion groove 17. The one rotation shaft 25 of the one shaft seat 24 is corresponding to the one fixing portion 15. The one rotation shaft 25 is fixed to the one fixing portion 15 by the screw bolt 26. The other shaft seat 24 is inserted into the other insertion groove 17, and the other rotation shaft 25 is inserted into the pivoting hole 16.

Referring to FIG. 4 to FIG. 13, when the at least one pivot portion 34 of the at least one lifting component 3 rotates to the second position 212, the retaining wall 27 compresses the second elastic element 43. When the at least one pivot portion 34 of the at least one lifting component 3 rotates to the first position 211, the retaining wall 27 releases the second elastic element 43 to release an elastic force compressed by the retaining wall 27 originally. The paper holding element 2 is driven by the elastic force of the second elastic element 43 to make the paper holding element 2 rotate with respect to the base 1 and along the two rotation shafts 25 of the two shaft seats 24, thereby the electric paper tray 100 rotates to switch to the closed state.

In this first preferred embodiment, after the paper holding element 2 is opened, the at least one first elastic element 42 provides the needed supporting force for the paper holding element 2, to ensure that the paper holding element 2 is opened to the proper design angle which is the predefined angle. The second elastic element 43 provides a closing force of the paper holding element 2 to ensure that the paper holding element 2 is closed. A design of the at least one supporting component 4 has a function of supporting a paper stacked weight and being without increasing the needed supporting force to open the paper holding element 2.

Figure 12:
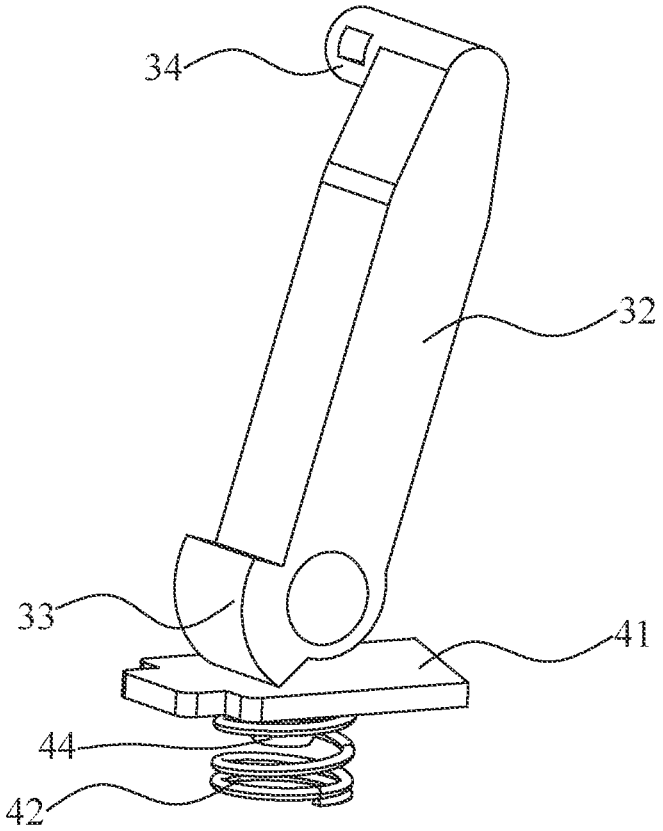
FIG. 12 is a perspective view of the automatic document feeder in accordance with the present invention, wherein a lifting component and a supporting component are opened.

Referring to FIG. 4 to FIG. 14, the opened state of the electric paper tray 100 is partially shown in FIG. 12. The electric paper tray 100 is controlled from the opened state to the closed state. When the electric paper tray 100 is about to be closed, a contacting point between the at least one friction pad 41 and the at least one cam 33 and a rotation axis of the at least one cam 33 are unaligned. When the at least one cam 33 overcomes a torque generated by an elastic force of the at least one first elastic element 42, the electric paper tray 100 is able to be closed.

Figure 13:
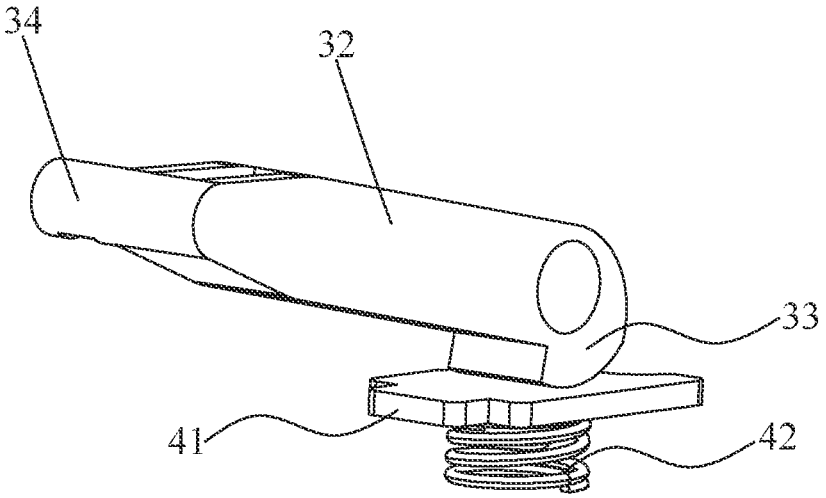
FIG. 13 is a perspective view of the automatic document feeder in accordance with the present invention, wherein the lifting component and the supporting component are closed.
Figure 14:
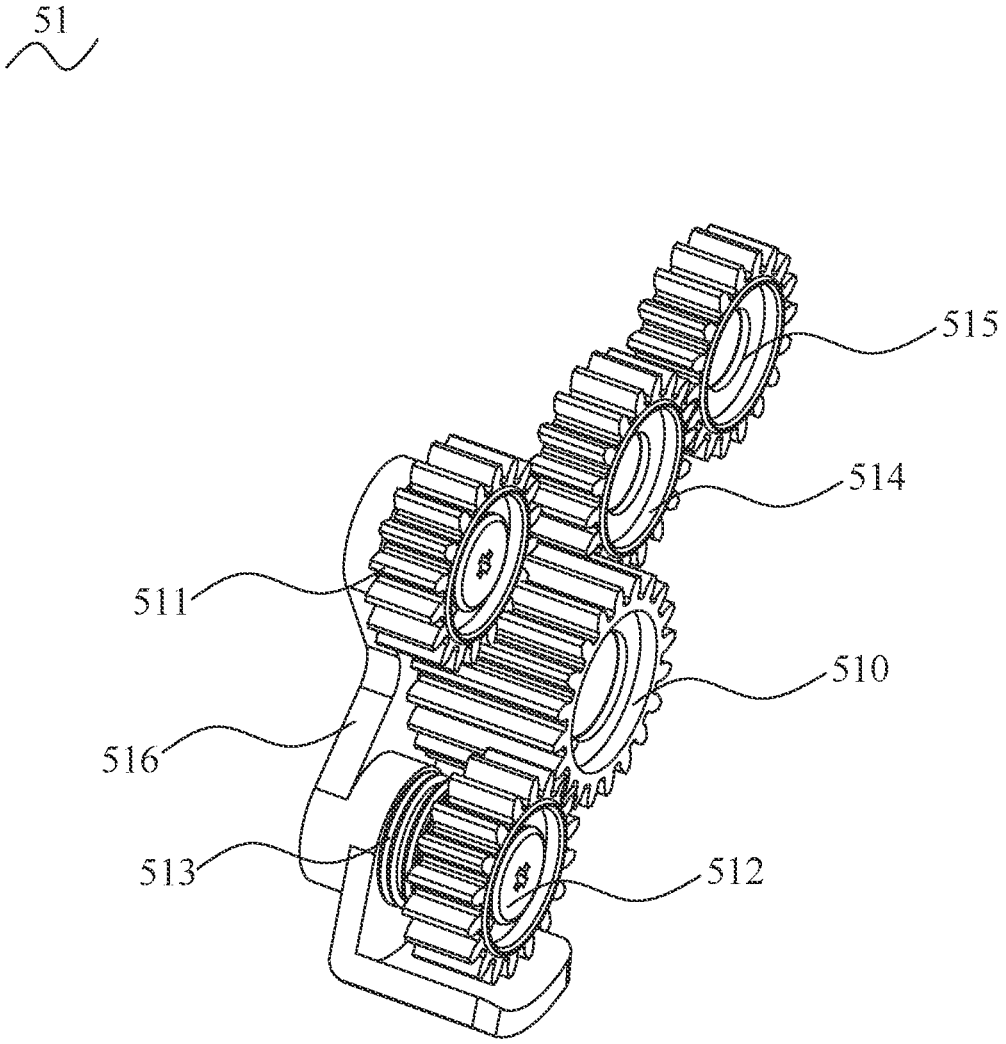
FIG. 14 is a perspective view of a planet gear assembly of the automatic document feeder in accordance with the present invention.
Figure 15:
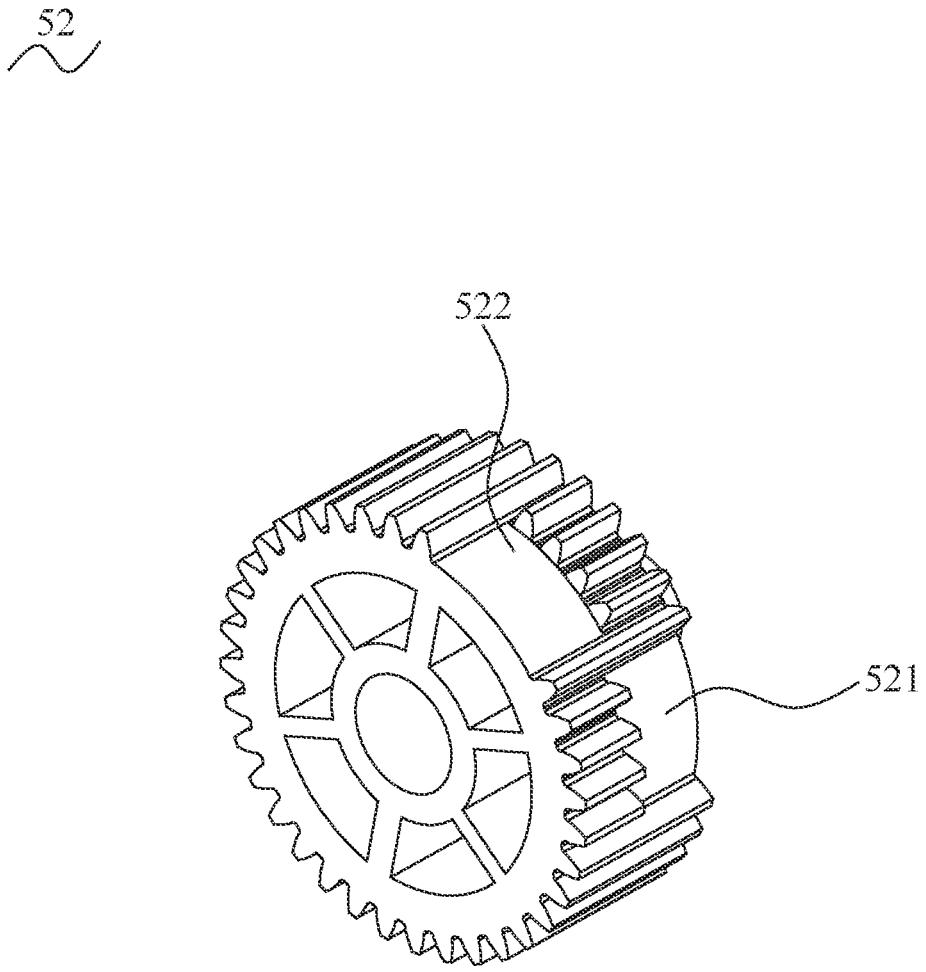
FIG. 15 is a perspective view of a missing teeth gear of the automatic document feeder in accordance with the present invention.
Figure 16:
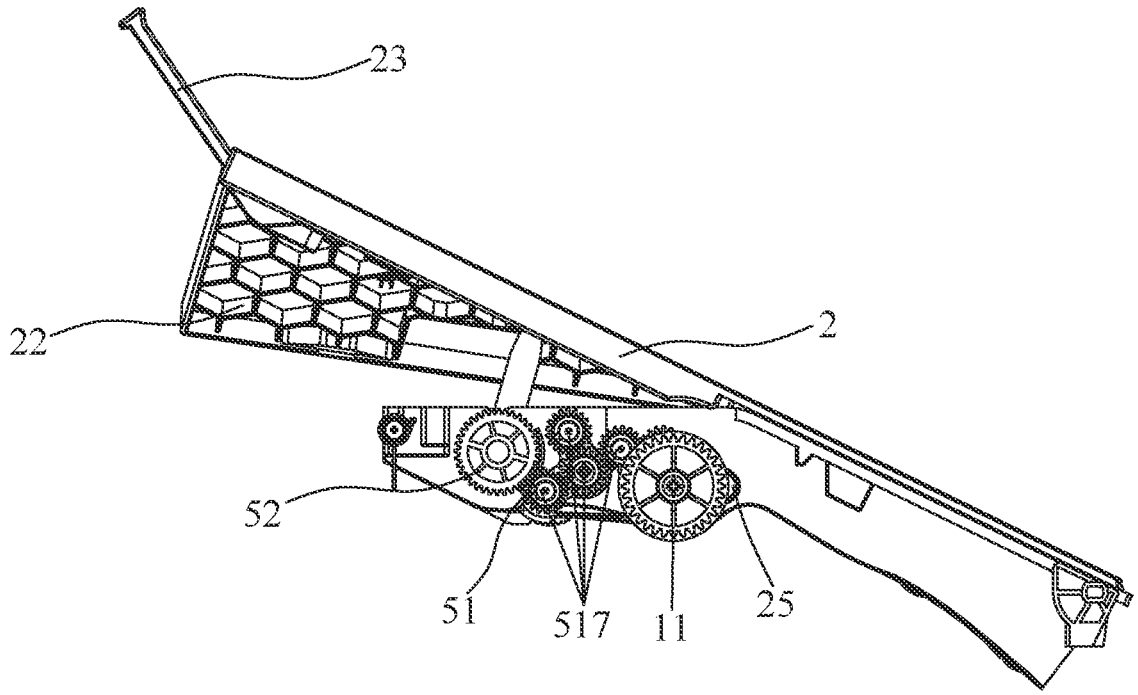
FIG. 16 is a partial structure position diagram of the electric paper tray of the automatic document feeder in accordance with the present invention, wherein the electric paper tray is opened.
Figure 17:
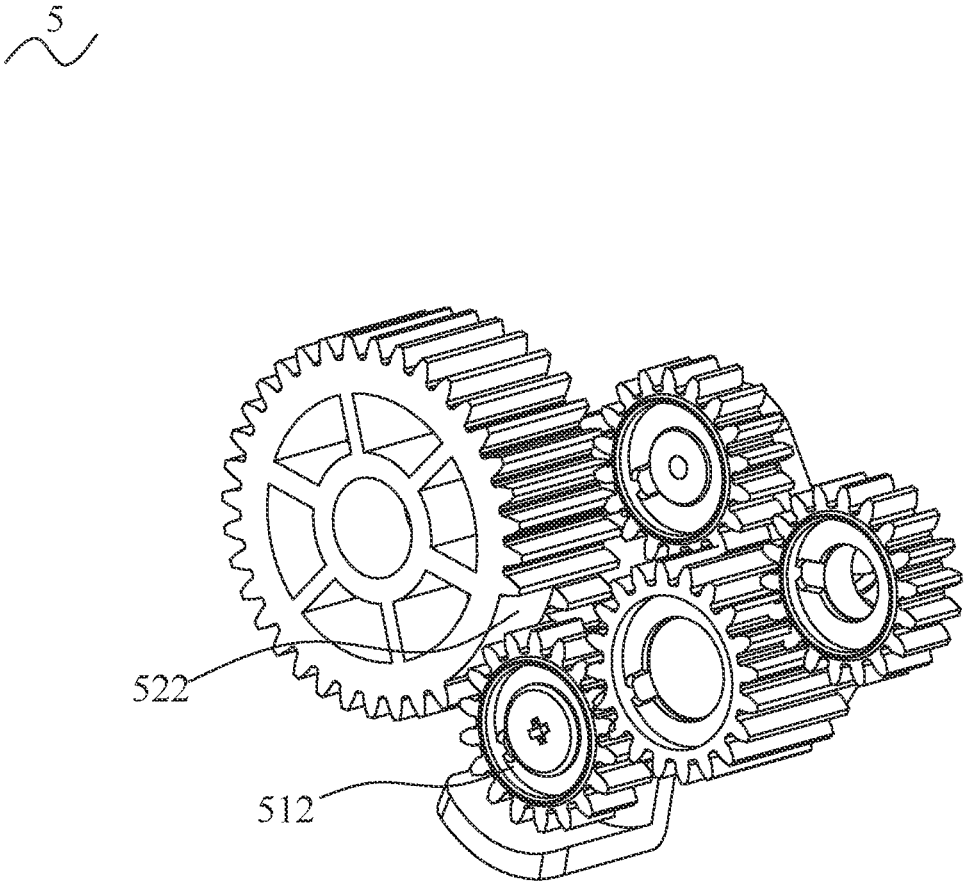
FIG. 17 is a perspective view of a transmission gear assembly of the automatic document feeder in accordance with the present invention, wherein the transmission gear assembly is opened.
Figure 18:
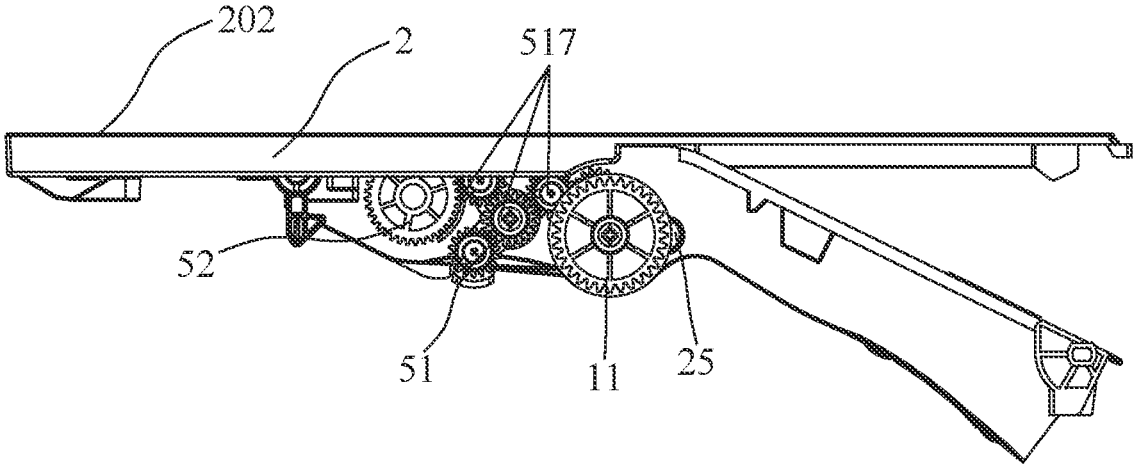
FIG. 18 is another partial structure position diagram of the electric paper tray of the automatic document feeder in accordance with the present invention, wherein the electric paper tray is closed.
Figure 19:
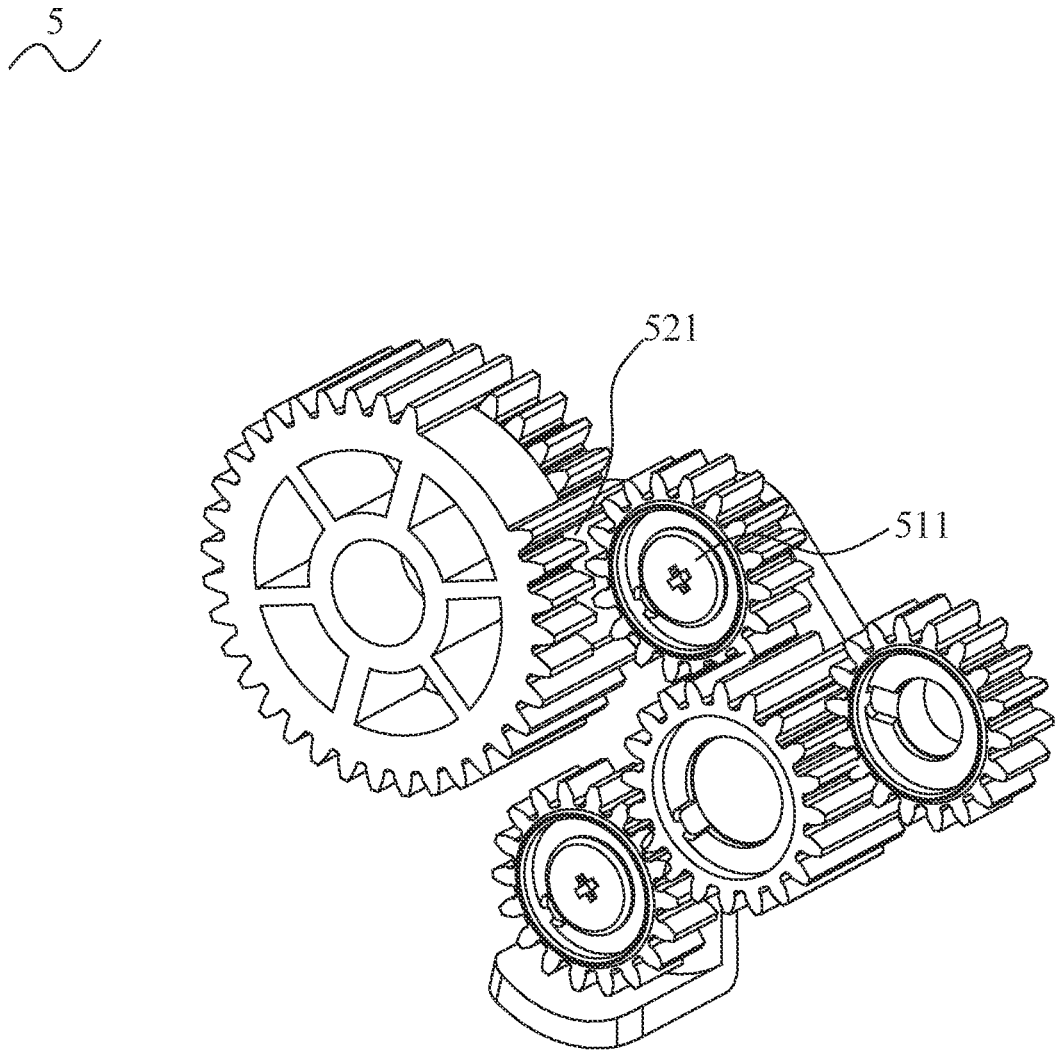
FIG. 19 is a perspective view of the transmission gear assembly of the automatic document feeder in accordance with the present invention, wherein the transmission gear assembly is closed.

Referring to FIG. 4 to FIG. 15, the closed state of the electric paper tray 100 is partially shown in FIG. 13. The electric paper tray 100 is controlled from the closed state to the opened state When the electric paper tray 100 is about to be opened, the contacting point between the at least one friction pad 41 and the at least one cam 33 and the rotation axis of the at least one cam 33 are aligned. When the at least one cam 33 overcomes a friction force generated from the at least one friction pad 41, the electric paper tray 100 is able to be opened.

Referring to FIG. 4 to FIG. 18, the transmission gear assembly 5 includes the separating gear 11, the connecting gear 13, a planet gear assembly 51 and a missing teeth gear 52. The connecting gear 13 is engaged with the planet gear assembly 51, and the planet gear assembly 51 is engaged with the missing teeth gear 52. The planet gear assembly 51 drives the missing teeth gear 52 to rotate. The missing teeth gear 52 is mounted to one end of the connecting rod 31 and is located at an outer surface of one side of the base 1. The missing teeth gear 52 is disposed adjacent to an outer side of the at least one supporting arm 32. The missing teeth gear 52 drives the connecting rod 31 to rotate, and the connecting rod 31 drives the supporting arm 32 to rotate, so that the transmission gear assembly 5 controls the at least one lifting component 3 to open and close the paper holding element 2. In this first preferred embodiment, the missing teeth gear 52 is able to drive the at least one lifting component 3 to lift the paper holding element 2 to be inclined at an inclination angle of twenty six degrees.

Referring to FIG. 12 to FIG. 21, the planet gear assembly 51 includes a center gear 510, a first gear 511, a second gear 512, a third elastic element 513, a third gear 514, a fourth gear 515 and a gear frame 516. The center gear 510 is engaged with the first gear 511, the second gear 512 and the third gear 514. The third elastic element 513 is arranged between the second gear 512 and the gear frame 516. The third elastic element 513 is used for exerting a force on the second gear 512 to make the second gear 512 generate a friction force at the time of the second gear 512 rotating clockwise or anticlockwise so as to drive the planet gear assembly 51 to switch from the first gear 511 to the second gear 512 to be engaged with the missing teeth gear 52, so that the driving force is transmitted to the missing teeth gear 52 to make the at least one lifting component 3 proceed with a lifting action or a descending action. When the second gear 512 rotates in a forward direction or a reverse direction, the planet gear assembly 51 will transmit the driving torque to the missing teeth gear 52 via the first gear 511 and the second gear 512 respectively, and the at least one lifting component 3 is lifted. The fourth gear 515 is engaged with the connecting gear 13, and the fourth gear 515 is engaged with the third gear 514. The gear frame 516 is arranged at one side of the center gear 510, one side of the first gear 511 and one side of the second gear 512. In this first preferred embodiment, each of the center gear 510, the third gear 514, the fourth gear 515 and the gear frame 516 is pivotally connected to the base 1 via a shaft needle 517. Each of the first gear 511 and the second gear 512 is pivotally connected to the gear frame 516 via another shaft needle 517.

Referring to FIG. 4 to FIG. 16, in the first preferred embodiment, the fourth gear 515 is engaged with the connecting gear 13, so a rotation direction of the connecting gear 13 is the same as a rotation direction of the separating gear 11, and a rotation direction of the fourth gear 515 is opposite to the rotation direction of the connecting gear 13. The rotation direction of the fourth gear 515 is opposite to a rotation direction of the third gear 514. The rotation direction of the third gear 514 is opposite to a rotation direction of the center gear 510, so the rotation direction of the center gear 510 is the same as the rotation direction of the fourth gear 515. A rotation direction of the first gear 511, a rotation direction of the second gear 512 and a rotation direction of the third gear 514 are the same. The rotation direction of the center gear 510, is different from the rotation direction of the first gear 511 and the rotation direction of the second gear 512.

The missing teeth gear 52 has a first toothless portion 521 and a second toothless portion 522. When the electric paper tray 100 is completely opened or closed, the first toothless portion 521 and the second toothless portion 522 are used for breaking the paper holding element 2 away from the power unit 6 so as to prevent the electric paper tray 100 rotating continuously to damage the electric paper tray 100. When the electric paper tray 100 is completely opened or closed, a force transmission is discontinued between the paper holding element 2 and the power unit 6 to avoid the electric paper tray 100 being damaged due to a continuous rotation.

Referring to FIG. 4 to FIG. 22, when the electric paper tray 100 is closed, the first gear 511 is corresponding to the first toothless portion 521, and thus disconnects the missing teeth gear 52 with the separating gear 11 to stop driving the paper holding element 2.

Referring to FIG. 14 to FIG. 24, when the electric paper tray 100 is opened, the second gear 512 is corresponding to the second toothless portion 522, and thus disconnects the missing teeth gear 52 with the separating gear 11 to stop driving the paper holding element 2. When the at least one lifting component 3 of the lifting module 221 moves to the first position 211, the first gear 511 is corresponding to the first toothless portion 521, and when the at least one lifting component 3 of the lifting module 221 moves to the second position 212, the second gear 512 is corresponding to the second toothless portion 522.

The automatic document feeder 300 further includes a feed-in sensor 101, a feed-out sensor 102, a lifting sensor 103 and an induction end 104. The feed-in sensor 101 is arranged in the automatic document feeder 300. The feed-in sensor 101 is disposed to a downstream of the paper loading tray 200 of the automatic document feeder 300.

Figure 20:
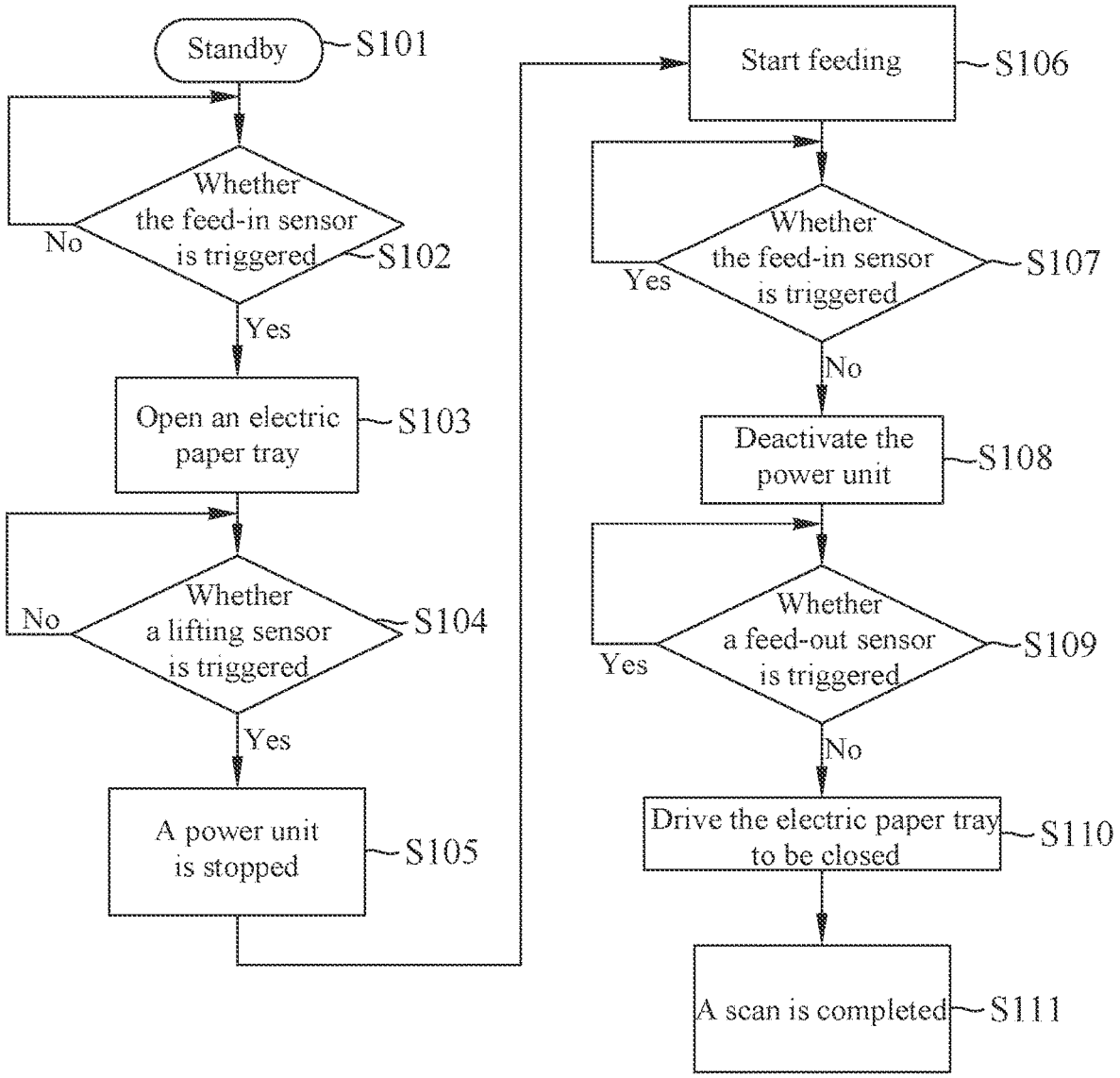
FIG. 20 is a flow chart showing a process of automatically opening and closing the electric paper tray in accordance with the present invention.
Figure 21:
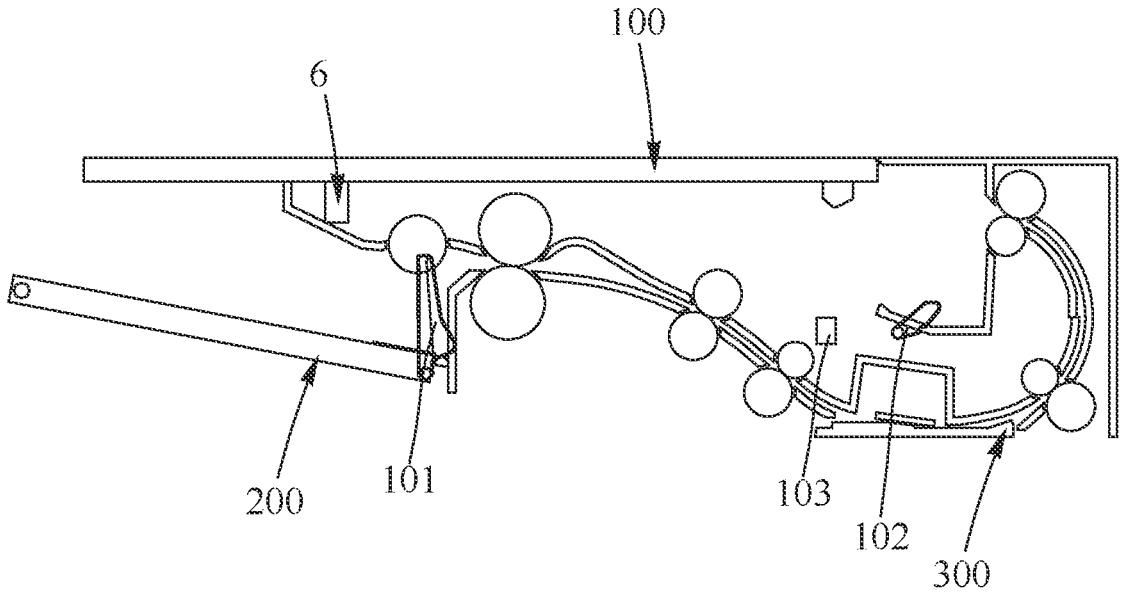
FIG. 21 is a schematic diagram of a power unit of the electric paper tray in accordance with a second preferred embodiment of the present invention.
Figure 22:
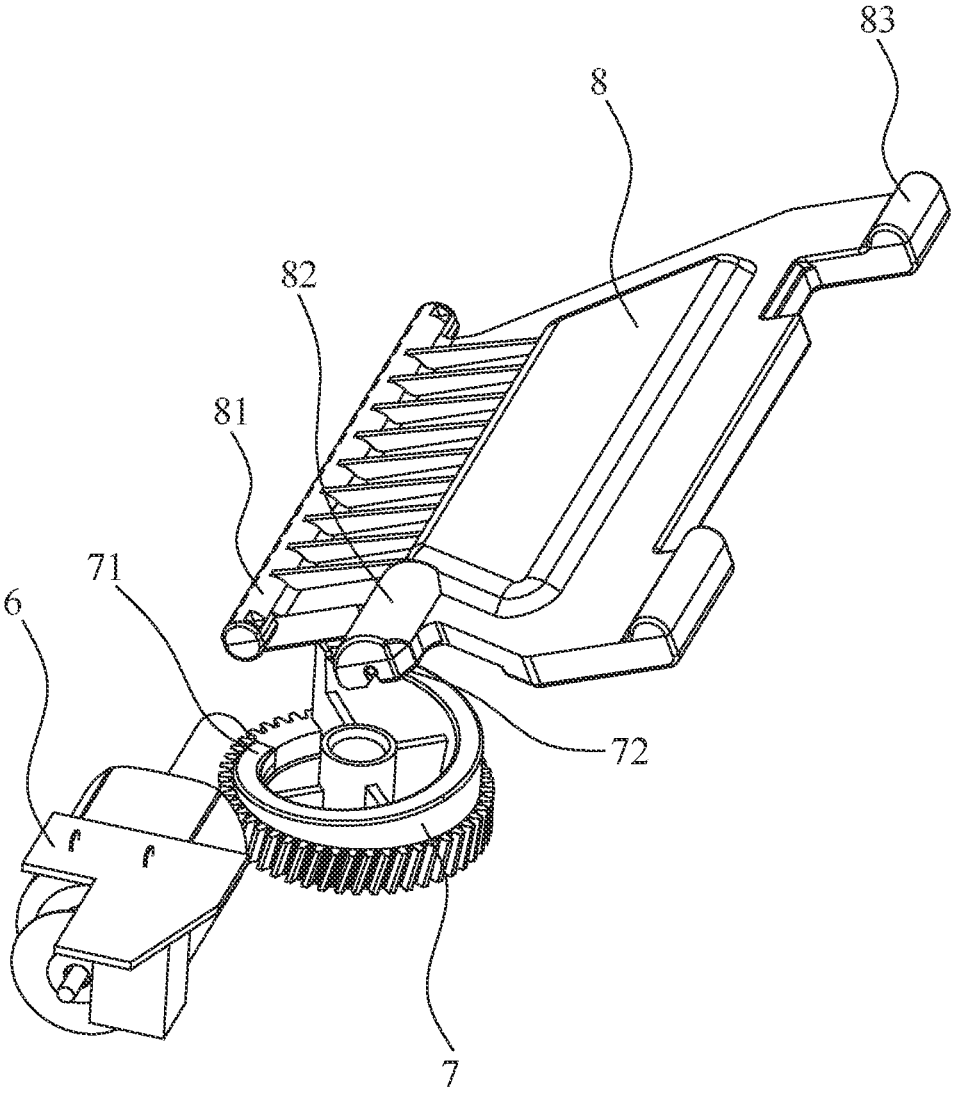
FIG. 22 is a perspective view of the power unit of the electric paper tray in accordance with the present invention, wherein the power unit is matched with a turbine mechanism and a lifting plate of the automatic document feeder to be used.
Figure 23:
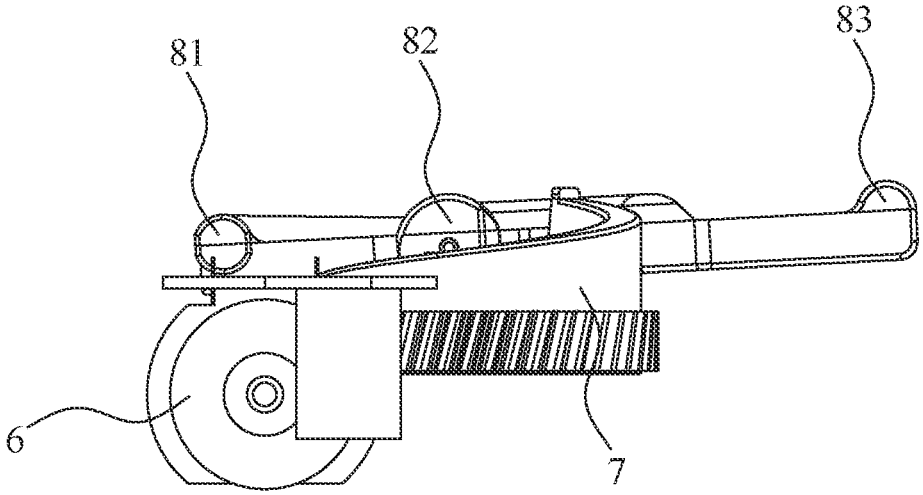
FIG. 23 is a side view of the power unit of the electric paper tray in accordance with the present invention, wherein the power unit is matched with the turbine mechanism and the lifting plate to be used and to be closed.
Figure 24:
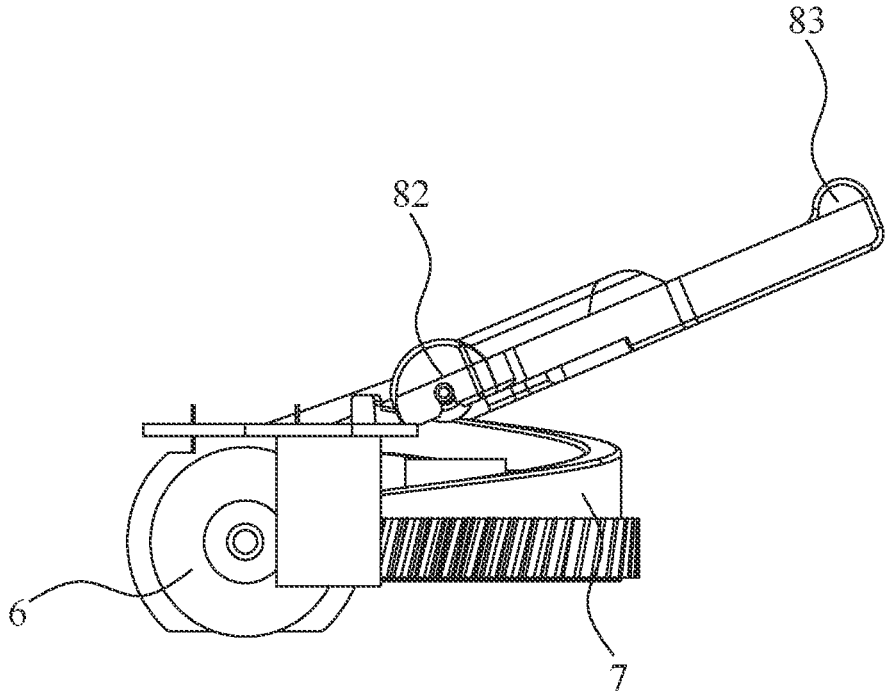
FIG. 24 is a side view of the power unit of the electric paper tray in accordance with the present invention, wherein the power unit is matched with the turbine mechanism and the lifting plate to be used and to be opened.
Figure 25:
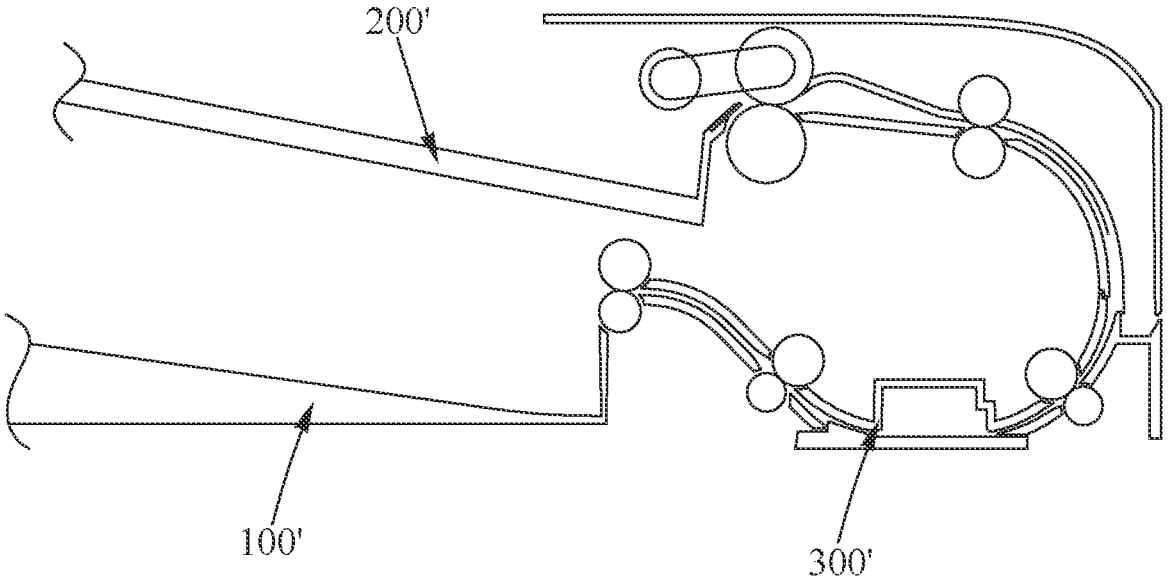
FIG. 25 (Prior Art)
FIG. 25 shows a schematic diagram of an automatic document feeder in prior art.
Figure 26:
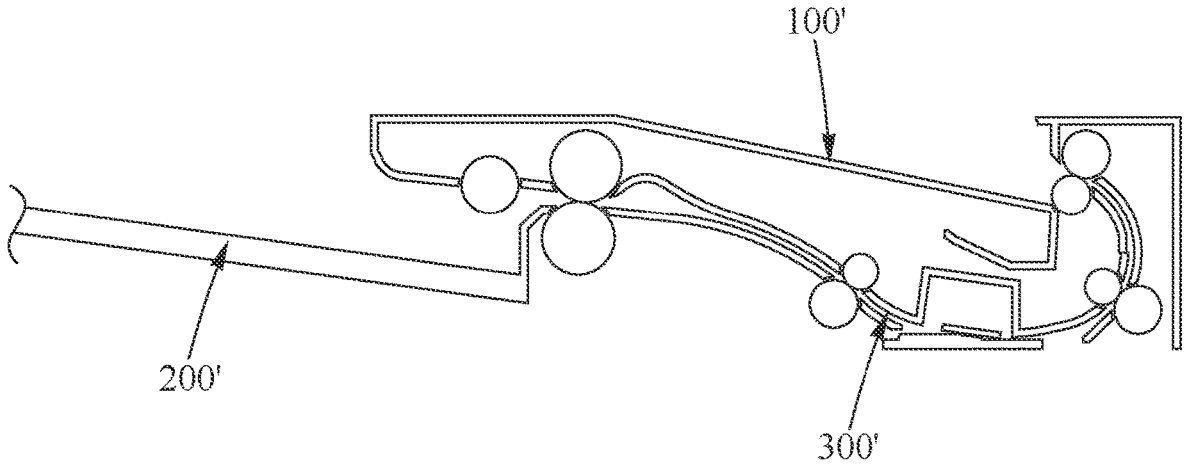
FIG. 26 (Prior Art)
FIG. 26 shows another schematic diagram of the automatic document feeder in the prior art.

Referring to FIG. 1 to FIG. 24, a flow chart of an automatic switching method of the automatic document feeder 300 with the electric paper tray 100 to automatically open or close the electric paper tray 100 is shown in FIG. 20. Specific steps of the automatic switching method of the electric paper tray 100 are described as below.

Step S101: firstly, be standby. the outer surface of the paper holding element 2 and the top surface of the automatic document feeder 300 are located at the same level. At the moment, the outer surface of the paper holding element 2 is performed as the appearance surface 202 of the automatic document feeder 300 to make the appearance of the automatic document feeder 300 flat so as to make the user feels comfortable.

Step S102: detect whether the paper is loaded in the paper loading tray 200 of the automatic document feeder 300 by the feed-in sensor 101 of the automatic document feeder 300, judge whether the feed-in sensor 101 is triggered, then execute a step S103 of driving the paper holding element 2 of the electric paper tray 100 by the power unit 6 to open the paper holding element 2 of the electric paper tray 100 if the feed-in sensor 101 detects the paper is loaded in the paper loading tray 200, the feed-in sensor 101 is triggered, on the contrary, repeat executing the step S102 of detecting whether the paper is loaded in the paper loading tray 200.

Step S103: then, drive the paper holding element 2 of the electric paper tray 100 by the power unit 6 of the electric paper tray 100 to open the paper holding element 2 of the electric paper tray 100.

Step S104: again, detect whether the paper holding element 2 of the electric paper tray 100 is opened and is switched from the first position 211 to the second position 212 by the lifting sensor 103 of the automatic document feeder 300, later, feed the paper into the automatic document feeder 300 by the pickup module 14 of the automatic document feeder 300, and feed out the paper to the paper holding element 2 of the electric paper tray 100 by the plurality of the transmission roller modules 301 of the automatic document feeder 300 if the paper holding element 2 of the electric paper tray 100 is opened to the second position 212, detect whether the lifting sensor 103 is triggered by the induction end 104 of the electric paper tray 100, if the lifting sensor 103 detects that the induction end 104 triggers the lifting sensor 103, then execute a step S105, on the contrary, repeat executing the step S104. In the first preferred embodiment, a rear end of the paper holding element 2 is acted as the induction end 104. When the electric paper tray 100 is opened, the rear end of the paper holding element 2 swung downward and trigger the lifting sensor 103.

Step S105: when the electric paper tray 100 is fully opened, the second gear 512 is corresponding to the second toothless portion 522 to break a link between the at least one lifting component 3 and the power unit 6, the driving force provided to the at least one lifting component 3 by the power unit 6 is interrupted by the missing teeth gear 52 for stopping driving the electric paper tray 100, the power unit 6 is stopped.

Step S106: the user operates the automatic document feeder 300, and presses a button on the automatic document feeder 300 to start feeding the paper, the automatic document feeder 300 starts transmitting the paper. In this step S106, the power unit 6 is activated to drive the pickup module 14 for feeding the paper into the automatic document feeder 300, and then execute a step S107. As shown in FIG. 3, the receiving space 201 for loading the paper is formed between the electric paper tray 100 and an upper surface of the automatic document feeder 300.

Step S107: detect whether the paper is fed into the automatic document feeder 300 by the feed-in sensor 101, namely, judge whether the feed-in sensor 101 is triggered, if no paper is detected in the paper loading tray 200, then execute a step S108, on the contrary, repeat executing the step S107.

Step S108: deactivate the power unit 6, feed the paper into the automatic document feeder 300 from the paper inlet 303 of the feeding path 302 and through the pickup module 14, then transmit the paper in the feeding path 302 and by the plurality of transmission roller modules 301, and finally, feed the paper out of the paper outlet 304 of the feeding path 302 to stack the paper in the electric paper tray 100, then execute a step S109.

Step S109: then, judge whether the paper is detected in the paper holding element 2 of the electric paper tray 100 by the feed-out sensor 102 of the automatic document feeder 300, namely judge whether the feed-out sensor 102 is triggered, if the feed-out sensor 102 detects the paper, then repeat executing the step S109, after the user removes all the paper, the feed-out sensor 102 is unable to detect any paper and then execute a step S110. In this first preferred embodiment, the feed-out sensor 102 is arranged to the receiving space 201 or the paper holding element 2. If any paper is fed to the receiving space 201 or the paper holding element 2, the feed-out sensor 102 will be triggered by the fed paper, thus the feed-out sensor 102 detects that there is the paper on the electric paper tray 100. On the contrary, when the paper is taken away from the receiving space 201 or the paper holding element 2, and the feed-out sensor 102 is without being triggered by the paper, so the feed-out sensor 102 judges that the paper on the electric paper tray 100 has been taken away.

Step S110: drive the lifting module 221 by the power unit 6 if the feed-out sensor 102 is unable to detect any paper in the paper holding element 2 of the electric paper tray 100, the lifting module 221 drives the paper holding element 2 of the electric paper tray 100 to move to the first position 211 to close the paper holding element 2 of the electric paper tray 100, at the moment, the outer surface of the paper holding element 2 of the electric paper tray 100 and the top surface of the base 1 of the electric paper tray 100 are connected and are shown as the continuous surface 203, and the outer surface of the paper holding element 2 of the electric paper tray 100 is used as the appearance surface 202 of the automatic document feeder 300, and then execute a step S111.

Step S111: when the electric paper tray 100 is fully closed, the first gear 511 is corresponding to the first toothless portion 521, the driving force of the at least one lifting component 3 provided from the power unit 6 is interrupted by the missing teeth gear 52 to stop driving the electric paper tray 100, at the moment, the upper surface of the paper holding element 2 is used as the appearance surface 202 of the automatic document feeder 300. A scan of the paper is completed.

In a concrete implementation, the feed-in sensor 101, the feed-out sensor 102 and the lifting sensor 103 are selectable from a group of optical sensors, a group of oscillating arm sensors or a group of the optical sensors and the oscillating arm sensors which are used in a combination. Any combination of the optical sensors and the oscillating arm sensors is appropriate for the feed-in sensor 101, the feed-out sensor 102 and the lifting sensor 103.

Referring to FIG. 1 to FIG. 24, an electric paper tray 100 in accordance with a second preferred embodiment of the present invention is shown. In the second preferred embodiment, the power unit 6 is assembled with and matched with a turbine mechanism 7 and a lifting plate 8. The power unit 6, the turbine mechanism 7 and the lifting plate 8 are positioned between the electric paper tray 100 and the bottom surface of the automatic document feeder 300. The power unit 6 drives the turbine mechanism 7. A corresponding mechanism of the lifting plate 8 adjusts a height of the lifting plate 8 along an inclined surface of the turbine mechanism 7 to open or close the electric paper tray 100. The lifting plate 8 is lifted or descended along the inclined surface of the turbine mechanism 7, so the electric paper tray 100 is opened or closed.

The lifting plate 8 has a first connection portion 81, a second connection portion 82 and a third connection portion 83. The first connection portion 81 is arranged at one end of the lifting plate 8 and is fastened to the base 1. The third connection portion 83 is arranged at the other end of the lifting plate 8, and the third connection portion 83 is fastened to the inner surface of the paper holding element 2. The third connection portion 83 is fastened to the bottom surface of the paper holding element 2. The second connection portion 82 is arranged between the first connection portion 81 and the third connection portion 83. The second connection portion 82 is positioned on the inclined surface of the turbine mechanism 7. When the second connection portion 82 is placed in a lower point 71, the third connection portion 83 is without lifting the paper holding element 2, and the lifting plate 8 remains horizontal. When the second connection portion 82 is placed in a higher point 72, the third connection portion 83 lifts the paper holding element 2, and at the moment, the third connection portion 83 is higher than the second connection portion 82, and the second connection portion 82 is higher than the first connection portion 81.

In the concrete implementation, the turbine mechanism 7 and the lifting plate 8 are able to replace the at least one lifting component 3 to be arranged in the electric paper tray 100. The at least one lifting component 3 is able to be an electromagnetic valve.

When the paper holding element 2 of the electric paper tray 100 is moved to the first position 211 or the second position 212, the driving force transmitted to the paper holding element 2 of the electric paper tray 100 by the power unit 6 is interrupted by the lifting module 221.

As described above, the electric paper tray 100 of the present invention transmits the driving force to the transmission gear assembly 5 of the electric paper tray 100 by means of the power unit 6, the transmission gear assembly 5 drives the at least one lifting component 3 of the electric paper tray 100 to make the paper holding element 2 proceed with an opened action and a closed action alternately, the first elastic element 42 of the electric paper tray 100 provides the needed supporting force to ensure that the paper holding element 2 can remain opened after the paper holding element 2 is opened. The second elastic element 43 of the electric paper tray 100 provides the closed force to close the paper holding element 2 to ensure that the paper holding element 2 is able to be closed. Thus, the electric paper tray 100 is able to be opened and closed automatically, stacked quality of the feed-out paper of the electric paper tray 100 is improved, a structural space of the electric paper tray 100 of the automatic document feeder 300 is reduced to lower a cost and increase an aesthetic feeling.

What is claimed is:

1. An electric paper tray used in an automatic document feeder, comprising:

a base;

a paper holding element pivotally mounted to at least one side of the base, a bottom of the paper holding element having at least one rotation shaft, the at least one rotation shaft being pivotally connected to the base;

a power unit arranged at the base; and a lifting module connected between the paper holding element and the power unit, the lifting module being movably mounted under the paper holding element and including at least one lifting component having a bottom arranged at one end of the base and a top slidably contacted with a bottom surface of the paper holding element, at least one supporting component arranged at the bottom of the at least one lifting component and fastened in the base, and a transmission gear assembly arranged at one side of the base, the power unit being connected with the transmission gear assembly and arranged at the one side of the base, wherein when the lifting module is driven by the power unit to move to a first position, with respect to the base, the lifting module drives the paper holding element to make the paper holding element rotate to a closed position via the at least one rotation shaft, an outer surface of the paper holding element and a top surface of the automatic document feeder are connected and are shown as a continuous surface, at the moment, the outer surface of the paper holding element is used as an appearance surface of the automatic document feeder, when the lifting module is driven by the power unit to move to a second position, with respect to the base, the lifting module drives the paper holding element to make the paper holding element rotate to an opened position via the at least one rotation shaft, at the moment, a receiving space is formed between the paper holding element and the automatic document feeder.

2. The electric paper tray as claimed in claim 1, wherein the at least one lifting component includes a connecting rod, at least one supporting arm, at least one cam and at least one pivot portion, the connecting rod passes through a bottom of the at least one supporting arm, the connecting rod is arranged in a front end of the base, the connecting rod is connected between the transmission gear assembly and the at least one supporting arm, the connecting rod is transversely mounted to the paper holding element, the at least one pivot portion is extended sideward from a top end of the at least one supporting arm, a front end of the bottom of the at least one supporting arm protrudes outward to form the at least one cam, a connecting portion between the connecting rod and the at least one supporting arm is located between the at least one cam and the at least one pivot portion, the at least one pivot portion abuts against an inner surface of the paper holding element, and the at least one cam abuts against the at least one supporting component.

3. The electric paper tray as claimed in claim 2, wherein a lower surface of the paper holding element which is the inner surface of the paper holding element has at least one sliding slot, the at least one lifting component is slidably disposed in the at least one sliding slot, two opposite ends of the at least one sliding slot are defined as the first position and the second position, respectively, the at least one pivot portion is slidable between the first position and the second position of the at least one sliding slot.

4. The electric paper tray as claimed in claim 2, wherein the lifting module includes two lifting components, the two lifting components include two supporting arms, two cams and two pivot portions, the connecting rod is connected to the two supporting arms, and the two supporting arms are arranged at two opposite ends of the connecting rod, front ends of the bottoms of the two supporting arms protrude outward to form the two cams.

5. The electric paper tray as claimed in claim 2, wherein the at least one supporting component includes at least one friction pad, at least one first elastic element, a second elastic element and at least one fixed shaft, the at least one cam is arranged on one side of a top surface of the at least one friction pad, the at least one fixed shaft is arranged at a bottom surface of the at least one friction pad, the at least one first elastic element is mounted around the at least one fixed shaft, two opposite ends of the first elastic element abut between the base and the at least one friction pad, two sides of an upper surface of the other side of the base protrude upward to form two blocking walls, two facing surfaces of the two blocking walls protrude toward each other to form two fixing portions, two opposite sides of the second elastic element sleeve around the two fixing portions, two opposite ends of the second elastic element abut between the base and the inner surface of the paper holding element.

6. The electric paper tray as claimed in claim 5, wherein two opposite sides of a top of the base are recessed downward to form two insertion grooves, the two fixing portions are adjacent to one insertion groove, one fixing portion projects beyond an outer surface of one blocking wall and projects into the one insertion groove, an outer wall of the other insertion groove defines a pivoting hole transversely penetrating through the outer wall of the other insertion groove, middles of two sides of the paper holding element protrude downward to form two shaft seats, a bottom of each shaft seat has one rotation shaft, the one rotation shaft of one shaft seat is hollow, the one fixing portion and the one rotation shaft are coaxial, the one shaft seat is inserted into the one insertion groove, the one rotation shaft of the one shaft seat is corresponding to the one fixing portion, the one rotation shaft is fixed to the one fixing portion by a screw bolt, the other shaft seat is inserted into the other insertion groove, and the other rotation shaft is inserted into the pivoting hole.

7. The electric paper tray as claimed in claim 5, wherein the at least one first elastic element is a compression spring, and the second elastic element is a torsion spring.

8. The electric paper tray as claimed in claim 1, wherein the transmission gear assembly includes a separating gear, a connecting gear, a planet gear assembly and a missing teeth gear, the connecting gear is coaxially connected to the separating gear, the connecting gear is engaged with the planet gear assembly, and the planet gear assembly is engaged with the missing teeth gear.

9. The electric paper tray as claimed in claim 8, wherein the planet gear assembly includes a center gear, a first gear, a second gear, a third elastic element, a third gear, a fourth gear and a gear frame, the center gear is engaged with the first gear, the second gear and the third gear, the third elastic element is arranged between the second gear and the gear frame, the fourth gear is engaged with the connecting gear, the fourth gear is engaged with the third gear, the gear frame is arranged at one side of the center gear, one side of the first gear and one side of the second gear, the missing teeth gear includes a first toothless portion and a second toothless portion, the separating gear is connected to the power unit, when the at least one lifting component of the lifting module moves to the first position, the first gear is corresponding to the first toothless portion and when the at least one lifting component of the lifting module moves to the second position, the second gear is corresponding to the second toothless portion.

10. The electric paper tray as claimed in claim 8, wherein the lifting module includes the separating gear and the connecting gear, the connecting gear is coaxially connected to the separating gear.

11. The electric paper tray as claimed in claim 1, wherein at least one side of a top of the base is recessed downward to form at least one insertion groove, a middle of at least one side of the paper holding element protrudes downward to form at least one shaft seat, a bottom of the at least one shaft seat has the at least one rotation shaft, the at least one shaft seat is inserted into the at least one insertion groove, the at least one rotation shaft is pivotally connected to the base.

12. An automatic document feeder with an electric paper tray, comprising:

a base;

a feeding path disposed in the base, an upstream and a downstream of the feeding path having a paper inlet and a paper outlet, respectively;

a pickup module mounted to the paper inlet;

a plurality of transmission roller modules arranged along the feeding path;

a paper loading tray disposed to one of the paper inlet and the paper outlet; and an electric paper tray disposed to the other one of the paper inlet and the paper outlet, the electric paper tray including a paper holding element pivotally mounted to at least one side of the base, a bottom of the paper holding element having at least one rotation shaft, the at least one rotation shaft being pivotally connected to the base, a power unit arranged at the base, and a lifting module connected between the paper holding element and the power unit, the lifting module being movably mounted under the paper holding element and including at least one lifting component having a bottom arranged at one end of the base and a top slidably contacted with a bottom surface of the paper holding element, at least one supporting component arranged at the bottom of the at least one lifting component and fastened in the base, and a transmission gear assembly arranged at one side of the base, the power unit being connected with the transmission gear assembly and arranged at the one side of the base, wherein when the lifting module is driven by the power unit to move to a first position, with respect to the base, the lifting module drives the paper holding element to make the paper holding element rotate to a closed position via the at least one rotation shaft, an outer surface of the paper holding element and a top surface of the base are connected and are shown as a continuous surface, at the moment, the outer surface of the paper holding element is used as an appearance surface of the automatic document feeder, the paper inlet or the paper outlet is shielded by the paper holding element of the electric paper tray, when the lifting module is driven by the power unit to move to a second position, with respect to the base, the lifting module drives the paper holding element to make the paper holding element rotate to an opened position via the at least one rotation shaft, at the moment, the paper inlet or the paper outlet is exposed out of the paper holding element of the electric paper tray.

13. The automatic document feeder with the electric paper tray as claimed in claim 12, wherein the at least one lifting component includes a connecting rod, at least one supporting arm, at least one cam and at least one pivot portion, the connecting rod passes through a bottom of the at least one supporting arm, the connecting rod is arranged in a front end of the base, the connecting rod is connected between the transmission gear assembly and the at least one supporting arm, the connecting rod is transversely mounted to the paper holding element, the at least one pivot portion is extended sideward from a top end of the at least one supporting arm, a front end of the bottom of the at least one supporting arm protrudes outward to form the at least one cam, a connecting portion between the connecting rod and the at least one supporting arm is located between the at least one cam and the at least one pivot portion, the at least one pivot portion abuts against an inner surface of the paper holding element, and the at least one cam abuts against the at least one supporting component.

14. The automatic document feeder with the electric paper tray as claimed in claim 13, wherein a lower surface of the paper holding element which is the inner surface of the paper holding element has at least one sliding slot, the at least one lifting component is slidably disposed in the at least one sliding slot, two opposite ends of the at least one sliding slot are defined as the first position and the second position, respectively, the at least one pivot portion is slidable between the first position and the second position of the at least one sliding slot.

15. The automatic document feeder with the electric paper tray as claimed in claim 13, wherein the at least one supporting component includes at least one friction pad, at least one first elastic element, a second elastic element and at least one fixed shaft, the at least one cam is arranged on one side of a top surface of the at least one friction pad, the at least one fixed shaft is arranged at a bottom surface of the at least one friction pad, the at least one first elastic element is mounted around the at least one fixed shaft, two opposite ends of the first elastic element abut between the base and the at least one friction pad, two sides of an upper surface of the other side of the base protrude upward to form two blocking walls, two facing surfaces of the two blocking walls protrude toward each other to form two fixing portions, two opposite sides of the second elastic element sleeve around the two fixing portions, two opposite ends of the second elastic element abut between the base and the inner surface of the paper holding element, two opposite sides of a top of the base are recessed downward to form two insertion grooves, the two fixing portions are adjacent to one insertion groove, one fixing portion projects beyond an outer surface of one blocking wall and projects into the one insertion groove, middles of two sides of the paper holding element protrude downward to form two shaft seats, a bottom of each shaft seat has one rotation shaft, the one fixing portion and the one rotation shaft are coaxial, the one shaft seat is inserted into the one insertion groove, the one rotation shaft of the one shaft seat is corresponding to the one fixing portion, the other shaft seat is inserted into the other insertion groove, the at least one first elastic element is a compression spring, and the second elastic element is a torsion spring.

16. The automatic document feeder with the electric paper tray as claimed in claim 13, wherein the transmission gear assembly includes a separating gear, a connecting gear, a planet gear assembly and a missing teeth gear, the connecting gear is coaxially connected to the separating gear, the connecting gear is engaged with the planet gear assembly, and the planet gear assembly is engaged with the missing teeth gear, the planet gear assembly includes a center gear, a first gear, a second gear, a third elastic element, a third gear, a fourth gear and a gear frame, the center gear is engaged with the first gear, the second gear and the third gear, the third elastic element is arranged between the second gear and the gear frame, the fourth gear is engaged with the connecting gear, the fourth gear is engaged with the third gear, the gear frame is arranged at one side of the center gear, one side of the first gear and one side of the second gear, the missing teeth gear includes a first toothless portion and a second toothless portion, the separating gear is connected to the power unit, when the at least one lifting component of the lifting module moves to the first position, the first gear is corresponding to the first toothless portion and when the at least one lifting component of the lifting module moves to the second position, the second gear is corresponding to the second toothless portion.

17. An automatic switching method of an automatic document feeder with an electric paper tray, comprising steps of:

detecting whether paper is loaded in a paper loading tray of the automatic document feeder by a feed-in sensor of the automatic document feeder;

driving a lifting module of the electric paper tray by a power unit of the electric paper tray to open a paper holding element of the electric paper tray if the feed-in sensor detects the paper is loaded in the paper loading tray, on the contrary, repeating detecting whether the paper is loaded in the paper loading tray;

detecting whether the paper holding element of the electric paper tray is opened and is switched from a first position to a second position by a lifting sensor of the automatic document feeder;

feeding the paper into the automatic document feeder by a pickup module of the automatic document feeder, and feeding the paper out to the paper holding element of the electric paper tray by a plurality of the transmission roller modules of the automatic document feeder if the paper holding element of the electric paper tray is opened to the second position;

judging whether the paper is detected in the paper holding element of the electric paper tray by a feed-out sensor of the automatic document feeder; and driving the lifting module by the power unit if the feed-out sensor is unable to detect any paper in the paper holding element of the electric paper tray, the lifting module driving the paper holding element of the electric paper tray to move to the first position to close the paper holding element of the electric paper tray, at the moment, an outer surface of the paper holding element of the electric paper tray and a top surface of a base of the electric paper tray being connected and being shown as a continuous surface, and the outer surface of the paper holding element of the electric paper tray being used as an appearance surface of the automatic document feeder;

wherein when the paper holding element of the electric paper tray is moved to the first position or the second position, a driving force transmitted to the paper holding element of the electric paper tray by the power unit is interrupted by the lifting module.

* * * * *